US011501721B2

(12) United States Patent
Yum et al.

(10) Patent No.: US 11,501,721 B2
(45) Date of Patent: Nov. 15, 2022

(54) DISPLAY DRIVING CIRCUIT, DISPLAY DEVICE INCLUDING THE SAME, AND OPERATING METHOD OF DISPLAY DRIVING CIRCUIT

(71) Applicant: SAMSUNG ELECTRONICS CO., LTD., Suwon-si (KR)

(72) Inventors: Joohyuk Yum, Yongin-si (KR); Byeongcheol Jang, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 12 days.

(21) Appl. No.: 17/034,720

(22) Filed: Sep. 28, 2020

(65) Prior Publication Data

US 2021/0280138 A1 Sep. 9, 2021

(30) Foreign Application Priority Data

Mar. 3, 2020 (KR) ..... 10-2020-0026797

(51) Int. Cl.
*G09G 3/3291* (2016.01)

(52) U.S. Cl.
CPC ... *G09G 3/3291* (2013.01); *G09G 2300/0452* (2013.01); *G09G 2310/027* (2013.01); *G09G 2320/0276* (2013.01)

(58) Field of Classification Search
CPC ... G09G 2320/0673; G09G 2320/0252; G09G 2320/0233; G09G 2320/0276; G09G 2320/0285; G09G 2320/08; G09G 2320/0271; G09G 3/3648; G09G 3/3208; G09G 3/36; G09G 3/3696; G09G 3/2096; G09G 2360/16; G09G 2360/147; G09G 2340/16; G09G 2310/027; G09G 2300/0452
See application file for complete search history.

(56) References Cited

U.S. PATENT DOCUMENTS

| | | | | |
|---|---|---|---|---|
| 5,625,373 | A | 4/1997 | Johnson | |
| 6,700,559 | B1 * | 3/2004 | Tanaka | G09G 3/3611 345/600 |
| 7,148,827 | B2 | 12/2006 | Lee | |
| 9,064,438 | B2 | 6/2015 | Hwang | |
| 9,111,489 | B2 | 8/2015 | Park et al. | |
| 9,153,177 | B2 | 10/2015 | Hong et al. | |
| 9,159,258 | B2 | 10/2015 | Lee | |
| 2006/0044242 | A1 * | 3/2006 | Park | G09G 3/3696 345/89 |

(Continued)

*Primary Examiner* — Dong Hui Liang
(74) *Attorney, Agent, or Firm* — Sughrue Mion, PLLC

(57) ABSTRACT

A display driving circuit includes: a grayscale voltage generator configured to generate a plurality of grayscale voltages by linearly dividing a plurality of gamma tap voltages; a gamma correction module configured to calculate a compensation value with respect to an input pixel value by using a compensation model, and configured to apply the compensation value to the input pixel value to generate a compensated pixel value; and a data driver configured to receive the plurality of grayscale voltages from the grayscale voltage generator, and configured to output a data voltage corresponding to a grayscale voltage to a display panel, the grayscale voltage being selected from the plurality of grayscale voltages based on the compensated pixel value.

16 Claims, 20 Drawing Sheets

(56) References Cited

U.S. PATENT DOCUMENTS

| | | | | |
|---|---|---|---|---|
| 2006/0087483 | A1* | 4/2006 | Takada | G09G 3/3688 345/89 |
| 2006/0268299 | A1* | 11/2006 | Nose | G09G 3/3648 358/1.9 |
| 2007/0153021 | A1* | 7/2007 | Umeda | G09G 3/2007 345/600 |
| 2008/0278521 | A1* | 11/2008 | Kang | G09G 3/2003 345/690 |
| 2010/0141559 | A1 | 6/2010 | Hwang | |
| 2011/0227955 | A1 | 9/2011 | Lee et al. | |
| 2012/0182329 | A1 | 7/2012 | Lin et al. | |
| 2015/0213750 | A1* | 7/2015 | Luo | H04N 1/64 345/597 |

* cited by examiner

FIG. 10

TB1

| Index (i) | Range of Pixel Value (Pi ≤ p < Pi+1) | Wcmpn(p) |
|---|---|---|
| 0 | R0: 0 ≤ p <1 | 0.0 |
| 1 | R1: 1 ≤ p <7 | 0.0 |
| ⋮ | ⋮ | ⋮ |
| 5 | R5: 35 ≤ p <51 | 1.68 |
| 6 | R6: 51 ≤ p <87 | 5.94 |
| 7 | R7: 87 ≤ p <151 | 8.06 |
| ⋮ | ⋮ | ⋮ |
| 10 | R10: 203 ≤ p ≤ 255 | 0.0 |

FIG. 13

TB2

| Index (i) | Range of Pixel Value (Pi ≤ p < Pi+1) | β | Wcmpn(p) |
|---|---|---|---|
| 0 | R0: 0 ≤ p <1 | 1 | 0.0 |
| 1 | R1: 1 ≤ p <7 | 1 | 0.0 |
| ⋮ | ⋮ | ⋮ | ⋮ |
| 5 | R5: 35 ≤ p <51 | 0.75 | 1.68 |
| 6 | R6: 51 ≤ p <87 | 1 | 5.94 |
| 7 | R7: 87 ≤ p <151 | 1.25 | 8.06 |
| ⋮ | ⋮ | ⋮ | ⋮ |
| 10 | R10: 203 ≤ p ≤ 255 | 1 | 0.0 |

DISPLAY DRIVING CIRCUIT, DISPLAY DEVICE INCLUDING THE SAME, AND OPERATING METHOD OF DISPLAY DRIVING CIRCUIT

CROSS-REFERENCE TO THE RELATED APPLICATION(S)

This application claims priority to Korean Patent Application No. 10-2020-0026797, filed on Mar. 3, 2020, in the Korean Intellectual Property Office, the disclosure of which is herein incorporated by reference in its entirety.

BACKGROUND

The inventive concept relates to a semiconductor apparatus, and more particularly, to a display driving circuit for driving a display panel to display an image on the display panel, an operating method of the display driving circuit, and a display device including the display driving circuit.

A display device includes a display panel, which displays an image, and a display driving circuit, which drives the display panel. The display driving circuit may receive image data from an external source and drive the display panel by applying an image signal corresponding to the image data to a data line of the display panel. A display panel, in which each of a plurality of pixels in a pixel array includes an organic light emitting diode (OLED) has been increasingly used.

A display driving circuit may drive a display panel by generating a plurality of grayscale voltages corresponding to a plurality of grayscales using a grayscale voltage generator, selecting one of the grayscale voltages based on a pixel value, and applying the selected grayscale voltage to a pixel as a data voltage. Some of the grayscale voltages generated by the grayscale voltage generator may be different from ideal grayscale voltages, and accordingly, distortion may occur in the luminance or color of an optical signal output from a pixel, causing a gamma error.

SUMMARY

The inventive concept provides a display driving circuit for reducing gamma errors based on compensation of a pixel value, a display device including the same, and an operating method of the display driving circuit.

According to an aspect of the inventive concept, there is provided a display driving circuit, including: a grayscale voltage generator configured to generate a plurality of grayscale voltages by linearly dividing a plurality of gamma tap voltages; a gamma correction module configured to calculate a compensation value with respect to an input pixel value by using a compensation model, and configured to apply the compensation value to the input pixel value to generate a compensated pixel value; and a data driver configured to receive the plurality of grayscale voltages from the grayscale voltage generator, and configured to output a data voltage corresponding to a grayscale voltage to a display panel, the grayscale voltage being selected from the plurality of grayscale voltages based on the compensated pixel value.

According to another aspect of the inventive concept, there is provided a method of operating a display driving circuit, the method including: calculating a compensation value with respect to a pixel value of input pixel data based on a compensation model; generating a compensated pixel value based on the pixel value and the compensation value; selecting, from a plurality of grayscale voltages, a grayscale voltage based on output pixel data including the compensated pixel value; and outputting a data voltage corresponding to the selected grayscale voltage to a display panel.

According to a further aspect of the inventive concept, there is provided a display device including: a display panel, and a display driving circuit configured to drive the display panel to display an image, wherein the display driving circuit includes: a grayscale voltage generator configured to determine a plurality of gamma tap voltages according to a plurality of select signals and configured to generate a plurality of grayscale voltages based on the plurality of gamma tap voltages; a gamma correction module configured to calculate a compensation value with respect to an input pixel value by using a compensation model, and configured to apply the compensation value to the input pixel value to generate a compensated pixel value; and a data driver configured to output a data voltage corresponding to a grayscale voltage to the display panel, the grayscale voltage being selected from the plurality of grayscale voltages based on the compensated pixel value.

BRIEF DESCRIPTION OF THE DRAWINGS

Embodiments of the inventive concept will be more clearly understood from the following detailed description taken in conjunction with the accompanying drawings in which:

FIG. 10 is an operation table applied to a compensation value calculator, according to an example embodiment;

FIG. 13 is an operation table applied to a compensation value calculator, according to an example embodiment;

DETAILED DESCRIPTION

Hereinafter, various example embodiments will be described with reference to the accompanying drawings.

Figure 1:
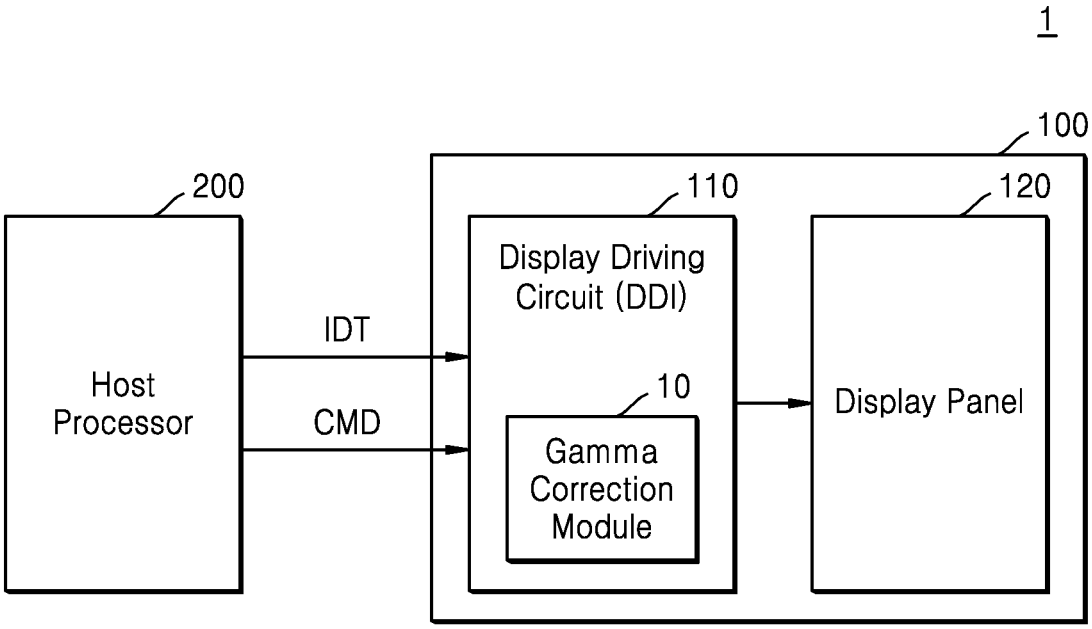
FIG. 1 is a block diagram of a display device and a display system including the same, according to an example embodiment.

FIG. 1 is a block diagram of a display device and a display system including the same, according to an example embodiment.

According to an example embodiment, a display system 1 may be mounted on an electronic device having an image display function. Examples of the electronic device may include, for example but not limited to, a smartphone, a tablet personal computer (PC), a portable multimedia player (PMP), a camera, a wearable device, a television, a digital video disk (DVD) player, a refrigerator, an air conditioner, a set-top box, a robot, a drone, a medical device, a navigation device, a global positioning system (GPS) receiver, a vehicle device, furniture, and measuring equipment.

Referring to FIG. 1, the display system 1 may include a display device 100 and a host processor 200, and the display device 100 may include a display driving circuit (or a display driving integrated circuit (DDI)) 110 and a display panel 120.

The host processor 200 may generate image data IDT to be displayed on the display panel 120 and transmit the image data IDT and a control command CMD to the display driving circuit 110. For example, the control command CMD may include setting information of luminance, gamma, a frame frequency, an operating mode of the display driving circuit 110, or the like. The host processor 200 may also transmit a clock signal or a synchronous signal to the display driving circuit 110.

The host processor 200 may include a graphics processor. However, embodiments are not limited thereto, and the host processor 200 may include various kinds of processors such as a central processing unit (CPU), a microprocessor, a multimedia processor, and an application processor. In an embodiment, the host processor 200 may include an integrated circuit (IC) or a system-on-chip (SoC).

The display device 100 may display the image data IDT received from the host processor 200. In an embodiment, the display device 100 may be implemented by integrating the display driving circuit 110 and the display panel 120 into a single module. For example, the display driving circuit 110 may be mounted on a substrate of the display panel 120 or may be electrically connected to the display panel 120 through a connecting member such as a flexible printed circuit board (FPCB).

The display panel 120 displays an image and may include a display, such as an organic light emitting diode (OLED) display, a thin film transistor-liquid crystal display (TFT-LCD), a field emission display, or a plasma display panel (PDP), which receives an electrically transmitted image signal and displays a two-dimensional (2D) image. Also, the display panel 120 may be a flat display or a flexible display panel. Hereinafter, for purpose of description, it is assumed that the display panel 120 includes an OLED display panel in which each pixel includes an OLED. However, embodiments are not limited thereto, and the display panel 120 may include a different kind of a display panel.

The display driving circuit 110 may convert the image data IDT received from the host processor 200 into a plurality of analog signals, e.g., data voltages, for driving the display panel 120 and provide the analog signals to the display panel 120. Consequently, an image corresponding to the image data IDT may be displayed on the display panel 120.

The display driving circuit 110 may include a gamma correction module 10. The gamma correction module 10 may generate a compensated pixel value by calculating a compensation value with respect to an input pixel value by using a compensation model having a form of a quadratic function and applying the compensation value to the input pixel value. In an embodiment, the gamma correction module 10 may generate a compensated grayscale voltage value by calculating a compensation value according to a received grayscale voltage value by using a compensation model and applying the compensation value to a grayscale voltage value. The grayscale voltage value and the compensated grayscale voltage value refer to digital data indicating a voltage level of a grayscale voltage.

The display driving circuit 110 may include a grayscale voltage generator (115 in FIG. 2), which converts an input pixel value into a grayscale voltage corresponding to a grayscale indicated by the input pixel value, and may apply the grayscale voltage corresponding to the input pixel value to a pixel of the display panel 120. Accordingly, the pixel may output an optical signal having luminance corresponding to the input pixel value. The grayscale voltage generator 115 may generate a plurality of grayscale voltages. The grayscale voltage generator 115 may have a limit in accurately generating the grayscale voltages respectively corresponding to a plurality of grayscales. For example, while an increase in a grayscale voltage with respect to an increase in grayscale needs to be non-linear to display an image having a desired gamma value on the display panel 120, the grayscale voltage generator 115 may generate grayscale voltages that linearly increase with respect to an increase between particular grayscales. The difference between an ideal grayscale voltage and a grayscale voltage generated by the grayscale voltage generator 115 may cause distortion occurring in the luminance and/or color of an optical signal output from a pixel. Such distortion may be referred to as a gamma error. Due to the gamma error, a banding artifact may appear in an image instead of a gradual color transition, and thus, a sharp color band is perceived.

As described above, the display driving circuit 110 may reduce gamma errors through compensation of a pixel value or voltage data. In addition, instead of storing compensation values respectively corresponding to a plurality of pixel values in a lookup table and finding a compensation value corresponding to a pixel value in the lookup table when the pixel value is input, the display driving circuit 110 may compensate a pixel value by calculating a compensation value corresponding to the pixel value by using a gamma error compensation model having a quadratic function form. Accordingly, a storage region for storing the compensation values is not needed.

Figure 2:
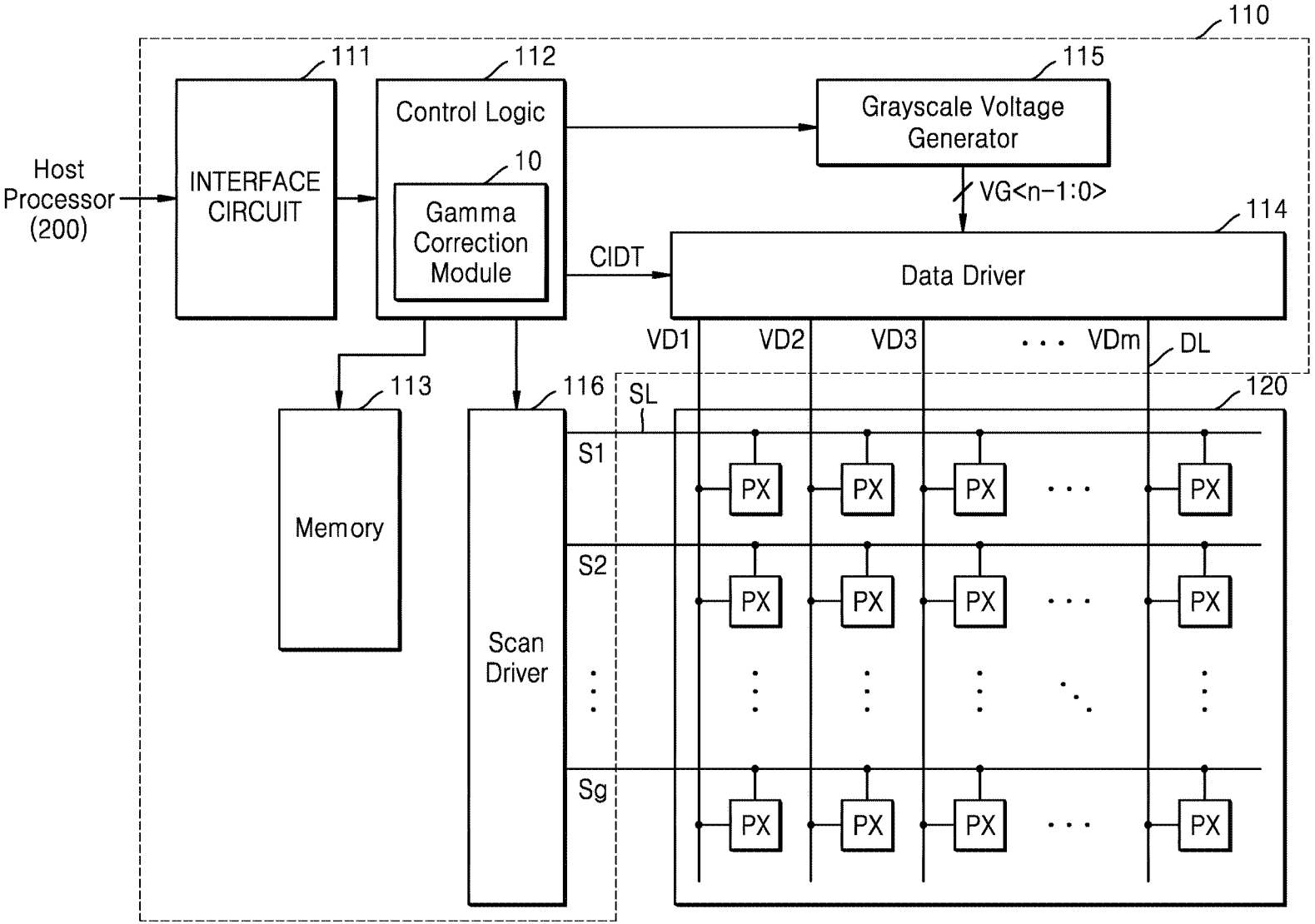
FIG. 2 is a block diagram of a display driving circuit and a display panel, according to an example embodiment.

FIG. 2 is a block diagram of a display driving circuit and a display panel, according to an example embodiment.

Referring to FIG. 2, the display driving circuit 110 may include an interface circuit 111, a control logic 112, a memory 113, a data driver 114 (or referred to as a source driver), the grayscale voltage generator 115, and a scan driver 116 (or referred to as a gate driver). The display driving circuit 110 may further include elements such as a voltage generator and a clock generator.

In an embodiment, the interface circuit 111, the control logic 112, the memory 113, the data driver 114, the grayscale voltage generator 115, and the scan driver 116 may be integrated into a single semiconductor chip. Alternatively, the interface circuit 111, the control logic 112, the memory 113, the data driver 114, and the grayscale voltage generator 115 may be integrated into a single semiconductor chip; and the scan driver 116 may be formed in the display panel 120.

The interface circuit 111 may exchange signals or data with the host processor 200. The interface circuit 111 may include a serial interface such as mobile industry processor interface (MIPI®), a mobile display digital interface (MDDI), DisplayPort, or an embedded display port (eDP).

The memory 113 may store image data, which is received from the host processor 200, in frame units. The memory 113 may be referred to as graphics random access memory (RAM) or a frame buffer. The memory 113 may include volatile memory, such as dynamic RAM (DRAM) or static RAM (SRAM), or non-volatile memory, such as read-only memory (ROM), flash memory, resistive RAM (ReRAM), or magnetic RAM (MRAM). Image data received from the host processor 200 may be stored in the memory 113 before or after undergoing image processing in the control logic 112. In an embodiment, the display driving circuit 110 may not include the memory 113. In this case, image data received from the host processor 200 may undergo image processing in the control logic 112 and may then be transmitted to the data driver 114.

The control logic 112 may control operations of the display driving circuit 110 and may control the elements, e.g., the interface circuit 111, the memory 113, the data driver 114, the grayscale voltage generator 115, and the scan driver 116, of the display driving circuit 110 such that an image corresponding to image data received from the host processor 200 is displayed on the display panel 120.

The control logic 112 may also perform image processing on received image data to change the luminance, size, or format of the received image data or may generate new image data to be displayed on the display panel 120 based on the received image data. For such an operation, the control logic 112 may include intellectual properties (IPs) for image processing.

The control logic 112 may include the gamma correction module 10. As described above with reference to FIG. 2, the gamma correction module 10 may generate and provide a compensated pixel value or a compensated grayscale voltage value CDT to the data driver 114. In an embodiment, the image data that has undergone image processing in the IPs for image processing may be input to the gamma correction module 10.

As shown in FIG. 2, the gamma correction module 10 may be implemented as a part of the control logic 112. However, embodiments are not limited thereto, and the gamma correction module 10 may be implemented as another control logic separated from the control logic 112.

The gamma correction module 10 may be implemented by hardware or a combination of software (or firmware) and hardware. The gamma correction module 10 may be implemented by a hardware logic such as an application specific integrated circuit (ASIC), a field programmable gate array (FPGA), or a complex programmable logic device (CPLD); firmware or software, which is run by a processor such as a micro controller unit (MCU) or a CPU; or a combination of hardware and software.

The grayscale voltage generator 115 may generate a plurality of grayscale voltages VG<n−1:0> (or referred to as gamma voltages), e.g., "n" gamma voltages VG<n−1:0> (where "n" is an integer of 2 or greater), based on a set gamma curve and provide the gamma voltages VG<n−1:0> to the data driver 114. The grayscale voltage generator 115 may adjust a maximum grayscale voltage and/or a minimum grayscale voltage according to a gamma setting value and adjust the gamma curve. The gamma curve is a graph showing the luminance of an optical signal, which is output from a pixel PX of the display panel 120, with respect to a plurality of grayscales. Voltage levels of the grayscale voltages VG<n−1:0> may be adjusted such that an optical signal having luminance corresponding to the set gamma curve is output, or the gamma curve may be adjusted according to the adjustment of the voltage levels of the grayscale voltages VG<n−1:0>.

The data driver 114 may convert compensated image data CDT, which is received from the control logic 112, into a plurality of image signals, e.g., a plurality of data voltages VD1 through VDm (where "m" is an integer of 2 or greater), and may output the data voltages VD1 through VDm to the display panel 120 through a plurality of data lines DL.

The data driver 114 may receive the compensated image data CDT in units of line data, that is, in units of data corresponding to a plurality of pixels included in a single horizontal line of a display panel. The data driver 114 may convert line data, which is received from the control logic 112, into the data voltages VD1 through VDm based on the grayscale voltages VG<n−1:0> received from the grayscale voltage generator 115.

The scan driver 116 may be connected to a plurality of scan lines SL of the display panel 120 and may sequentially drive the scan lines SL. The scan driver 116 may sequentially provide a plurality of scan signals Si through Sg (where "g" is a positive integer of 2 or greater) having an active level, e.g., a logic high level, to the scan lines SL under the control of the control logic 112. Accordingly, the scan lines SL may be sequentially selected, and the data voltages VD1 through VDm may be respectively applied to a plurality of pixels PX connected to a selected scan line SL.

The display panel 120 may include the plurality of data lines DL, the plurality of scan lines SL, and a plurality of pixels PX, each of which is connected to a corresponding one of the plurality of scan lines SL and a corresponding one of the plurality of data lines DL.

Each of the pixels PX may output a predetermined color of light, and at least two pixels PX (e.g., red, blue, and/or green pixels), which are adjacent to each other in one line or in adjacent lines and respectively output different colors of light, may form a single pixel unit. The at least two pixels PX forming a pixel unit may be referred to as sub-pixels. The display panel 120 may have an RGB structure in which red, blue, and green pixels form a single pixel unit. However, embodiments are not limited thereto, and the display panel 120 may have any alternative structure, for example, an RGBW structure, in which a pixel unit further includes a white pixel for luminance enhancement. Alternatively, a pixel unit of the display panel 120 may include pixels of other colors than red, green, and blue.

The display panel 120 may include an OLED display panel, in which each of the pixels PX includes an OLED. However, embodiments are not limited thereto, and the display panel 120 may include another other type of a display panel. The display panel 120 may be a flat display panel or a flexible display panel.

In an embodiment, the data driver 114 may sense a change in electrical characteristics, e.g., a degradation degree, of the pixels PX. The display panel 120 may further include a plurality of sensing lines and a plurality of sensing scan lines, which are connected to the pixels PX. When the scan driver 116 drives the sensing scan lines, the electrical characteristics of the pixels PX connected to the sensing scan lines may be transmitted to the data driver 114 through the sensing lines. The data driver 114 may convert a sensed signal into sensed data and provide the sensed data to the control logic 112, and the control logic 112 may determine a degradation degree of the pixels PX based on the sensed data and perform degradation compensation on the pixels PX.

Figure 3:
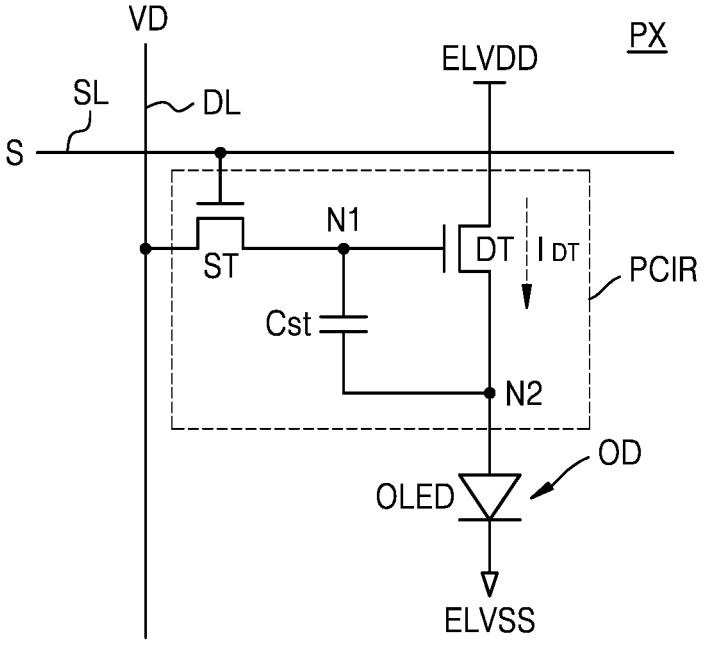
FIG. 3 is a circuit diagram of an example of a pixel according to an example embodiment.

FIG. 3 is a circuit diagram of an example of a pixel according to an example embodiment.

Referring to FIG. 3, a pixel PX may include an OLED OD and a pixel circuit PCIR. An anode of the OLED OD may be connected to the pixel circuit PCIR, and a cathode of the OLED OD may be connected to a second driving power supply ELVSS. The OLED OD may emit light with luminance corresponding to the amount of current supplied from the pixel circuit PCIR.

The pixel circuit PCIR controls an amount of current, which flows from a first driving power supply ELVDD to the second driving power supply ELVSS via the OLED OD, in response to a data voltage VD. The pixel circuit PCIR may include a select transistor ST, a drive transistor DT, and a storage capacitor Cst. At least one selected from the select transistor ST and the drive transistor DT may include an oxide semiconductor thin-film transistor, which includes an active layer including an oxide semiconductor, or a low-temperature polycrystalline silicone (LTPS) thin-film transistor, which includes an active layer including polysilicon.

A first electrode of the drive transistor DT is connected to the first driving power supply ELVDD, and a second electrode of the drive transistor DT is connected to the anode of the OLED OD (e.g., a second node N2). A gate electrode of the drive transistor DT may be connected to a first node N1. The drive transistor DT may control the amount of current, which flows from the first driving power supply ELVDD to the second driving power supply ELVSS via the OLED OD, in response to a voltage of the first node N1.

A first electrode of the select transistor ST is connected to a data line DL, and a second electrode of the select transistor ST is connected to the first node N1. A gate electrode of the select transistor ST is connected to a scan line SL.

The storage capacitor Cst is connected between the first node N1 and the second electrode of the drive transistor DT, i.e., the second node N2. The storage capacitor Cst may store the voltage of the first node N1.

When a scan signal S at an active level is applied to the pixel PX through the scan line SL, the select transistor ST may be turned on in response to the scan signal S and provide the data voltage VD, which is provided through the data line DL, to the first node N1; and the storage capacitor Cst may store the data voltage VD. The drive transistor DT may provide a driving current IDT to the OLED OD in response to the data voltage VD.

In an embodiment, the pixel circuit PCIR may further include a sensing transistor configured to output a sensing signal, e.g., a voltage of the second node N2, wherein the sensing signal indicates an electrical characteristic of the pixel PX. The sensing transistor may be turned on in response to a sensing scan signal and may output a sensed signal to a sensing line (for example, included in the display panel 120 in FIG. 2).

The structure of the pixel PX of FIG. 3 is only an example, and the structure of the pixel PX is not limited thereto. For example, differently from FIG. 3, the OLED OD may be between the first driving power supply ELVDD and the first electrode of the drive transistor DT. Additionally or alternatively, the pixel PX may further include another transistor to control a light emitting period thereof or to enhance a driving characteristic thereof.

Figure 4:
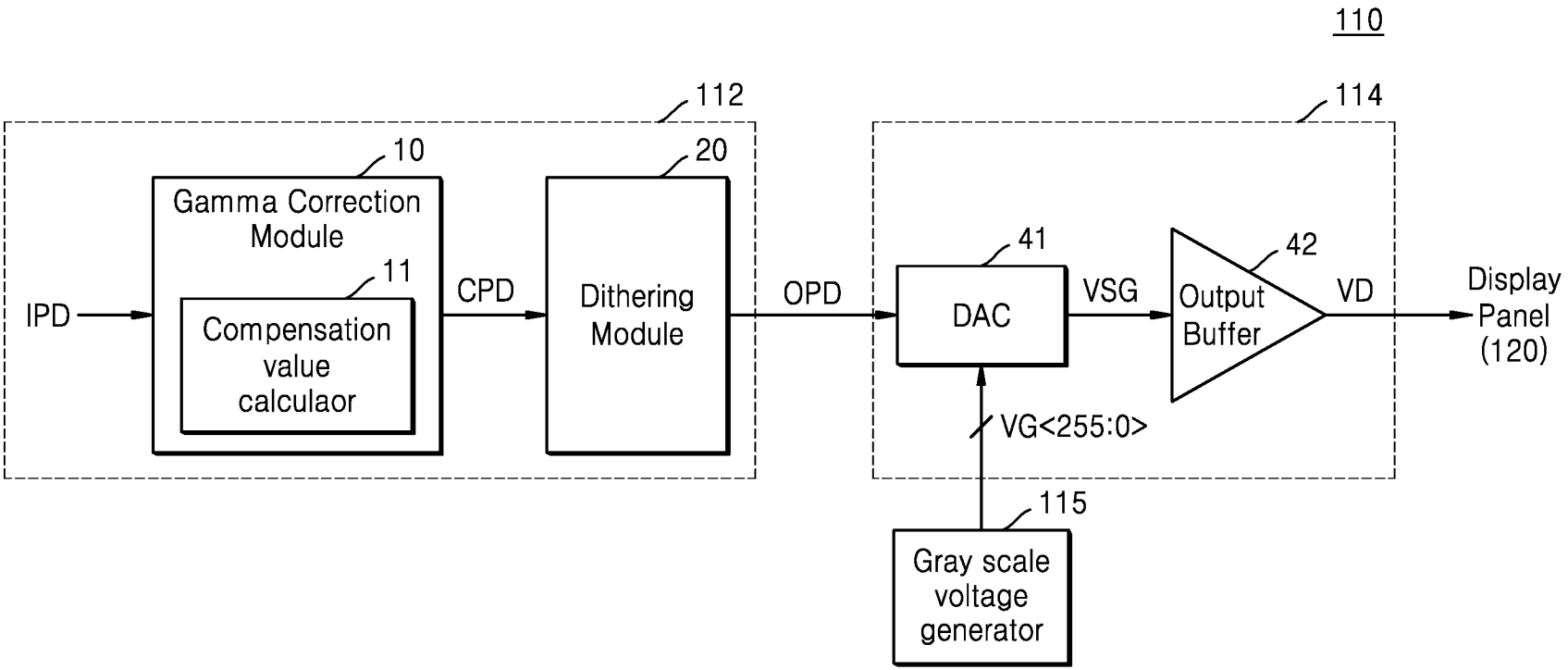
FIG. 4 is a schematic block diagram of a display driving circuit according to an example embodiment.

FIG. 4 is a schematic block diagram of a display driving circuit according to an example embodiment.

Referring to FIG. 4, the control logic 112 may include the gamma correction module 10 and a dithering module 20, and the data driver 114 may include a digital-to-analog converter (DAC) 41 and an output buffer 42. Although FIG. 4 illustrates that the data driver 114 includes a driving circuit, which includes the DAC 41 and the output buffer 42, for a single channel, this is only for convenience of description. The data driver 114 may include a driving circuit for multiple channels.

The gamma correction module 10 may receive input pixel data IPD, perform gamma correction on the input pixel data IPD, and output compensated pixel data CPD as the gamma correction result. The gamma correction module 10 may generate a compensated pixel value by calculating a compensation value with respect to an input pixel value, indicated by the input pixel data IPD by using a compensation model having a quadratic function form, and applying the compensation value to the input pixel value. The gamma correction module 10 may output the compensated pixel data CPD having a compensated pixel value. In this manner, the gamma correction module 10 may perform gamma correction.

Gamma correction will be described in detail with reference to FIGS. 5 through 6B.

Figure 5:
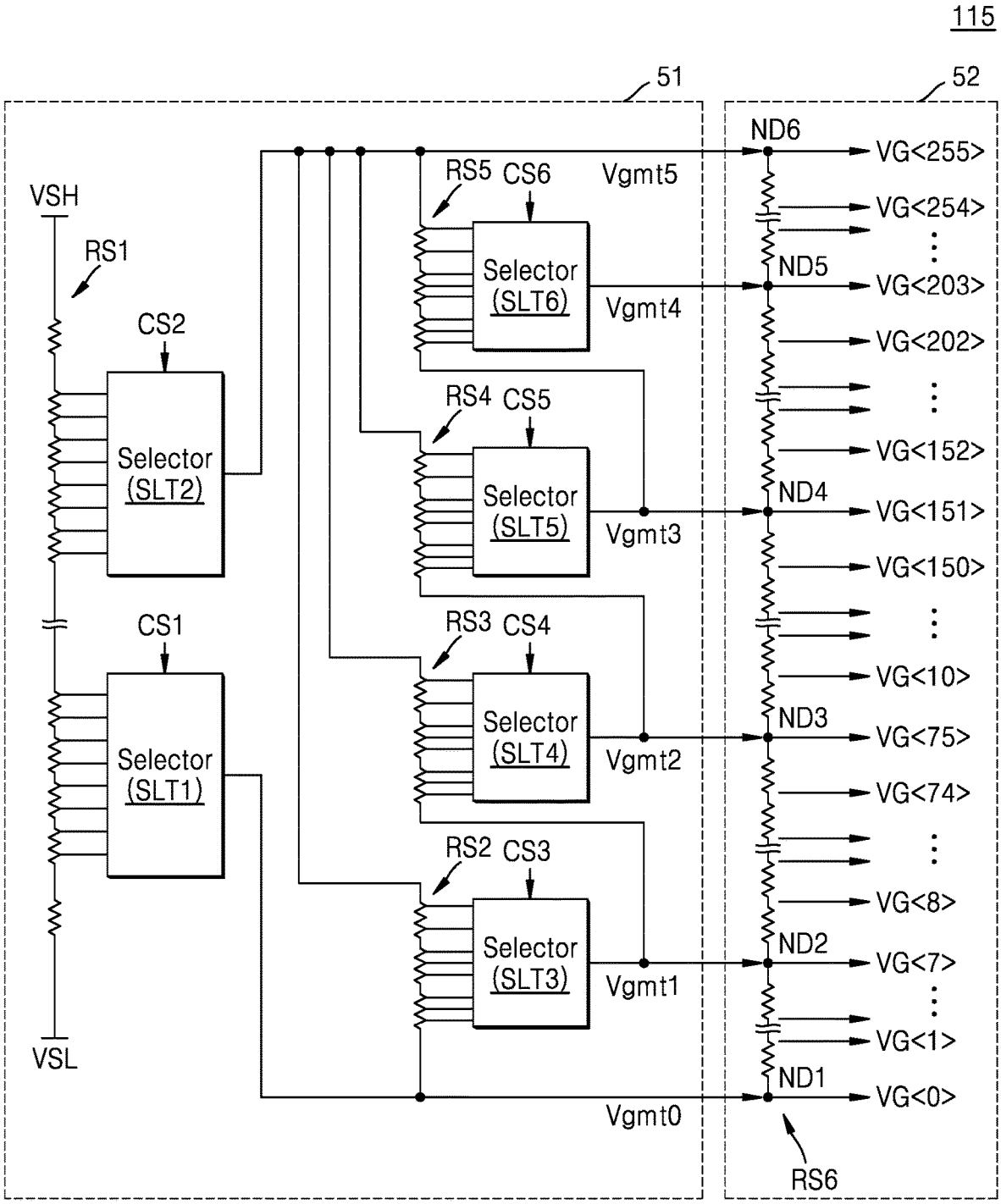
FIG. 5 is a circuit diagram of an example of a grayscale voltage generator in FIG. 4.

FIG. 5 is a circuit diagram of an example of the grayscale voltage generator 115 in FIG. 4. For purpose of illustration, it is assumed that the grayscale voltage generator 115 generates 256 grayscale voltages VG<255:0>.

Referring to FIG. 5, the grayscale voltage generator 115 may include a gamma tap voltage generator 51 and a grayscale voltage outputter 52. The gamma tap voltage generator 51 may generate a plurality of gamma tap voltages, e.g., zeroth through fifth gamma tap voltages Vgmt0 through Vgmt5, corresponding to a plurality of gamma taps that determine a gamma curve. Based on the zeroth through fifth gamma tap voltages Vgmt0 through Vgmt5, the grayscale voltage outputter 52 may generate a plurality of grayscale voltages, e.g., zeroth through 255th grayscale voltages VG<0> through VG<255>, respectively corresponding to a plurality of grayscales (e.g., 256 grayscale voltages). The gamma taps may refer to particular grayscales, e.g., reference grayscales, determining a gamma curve among the grayscales; and the zeroth through fifth gamma tap voltages Vgmt0 through Vgmt5 may correspond to some of the grayscales, e.g., the zeroth through 255th grayscale voltages VG<0> through VG<255>.

The gamma tap voltage generator 51 may include a plurality of resistor strings, e.g., first through fifth resistor strings RS1 through RS5, and a plurality of selectors, e.g., first through sixth selectors SLT1 through SLT6. The numbers of resistor strings and selectors may vary. Although not shown, the gamma tap voltage generator 51 may further include a plurality of buffers, e.g., current buffers, to reliably maintain voltage levels of the zeroth through fifth gamma tap voltages Vgmt0 through Vgmt5 respectively output from the first through sixth selectors SLT1 through SLT6.

Each of the first through fifth resistor strings RS1 through RS5 may generate a plurality of voltages by dividing a voltage applied to both ends of each resistor string by using a plurality of resistors included in each the resistor string and may output the voltages. Each of the first through sixth selectors SLT1 through SLT6 may select one of the voltages output from a corresponding resistor string based on a corresponding one of a plurality of select signals, e.g., first through sixth select signals CS1 through CS6, and output the selected voltage. Consequently, the zeroth through fifth gamma tap voltages Vgmt0 through Vgmt5 may be generated.

For example, the first resistor string RS1 may generate a plurality of voltages by dividing a voltage between a high reference voltage VSH and a low reference voltage VSL, and the first selector SLT1 may select one of the plurality of voltages received from the first resistor string RS1 in response to the first select signal CS1 and output the selected voltage as the zeroth gamma tap voltage Vgmt0. The zeroth gamma tap voltage Vgmt0 may correspond to a lowest grayscale voltage, e.g., the zeroth grayscale voltage VG<0>. The second selector SLT2 may select one of the voltages received from the first resistor string RS1 in response to the second select signal CS2 and output the selected voltage as the fifth gamma tap voltage Vgmt5. The fifth gamma tap voltage Vgmt5 may correspond to a highest grayscale voltage, e.g., the 255th grayscale voltage VG<255>.

Each of the second through fifth resistor strings RS2 through RS5 may divide a voltage between the fifth gamma tap voltage Vgmt5 and another gamma tap voltage (e.g., one of the zeroth through three gamma tap voltages Vgmt0 through Vgmt3) using the resistors thereof and output a plurality of voltages. Each of the third through sixth selectors SLT3 through SLT6 may select one of the voltages, which are received from a corresponding one of the second through fifth resistor strings RS2 through RS5, in response to a corresponding one of the third through sixth select signals CS3 through CS6 and may output the selected voltage as one of the first through fourth gamma tap voltages Vgmt1 through Vgmt4. Each of the first through fourth gamma tap voltages Vgmt1 through Vgmt4 may correspond to one of medium grayscale voltages. For example, the first gamma tap voltage Vgmt1 may be output as the seventh grayscale voltage VG<7>, the second gamma tap voltage Vgmt2 may be output as the 75th grayscale voltage VG<75>, the third gamma tap voltage Vgmt3 may be output as the 151st grayscale voltage VG<151>, and the fourth gamma tap voltage Vgmt4 may be output as the 203rd grayscale voltage VG<203>, Accordingly, the gamma tap voltage generator 51 may generate a plurality of gamma tap voltages, e.g., the zeroth through fifth gamma tap voltages Vgmt0 through Vgmt5, corresponding to a plurality of gamma taps (e.g., a plurality of reference grayscales). The first through sixth select signals CS1 through CS6 may be changed, and voltage levels of the zeroth through fifth gamma tap voltages Vgmt0 through Vgmt5 may be adjusted. Accordingly, the highest grayscale voltage and the lowest grayscale voltage may be respectively adjusted according to the first select signal CS1 and the second select signal CS2, and a plurality of medium grayscale voltages determining a gamma curve may be adjusted according to the third through sixth select signals CS3 through CS6.

The grayscale voltage outputter 52 may include a resistor string, e.g., the sixth resistor string RS6, to which a plurality of gamma tap voltages, e.g., the zeroth through fifth gamma tap voltages Vgmt0 through Vgmt5, are applied. The sixth resistor string RS6 may generate a plurality of grayscale voltages, e.g., the zeroth through 255th grayscale voltages VG<0> through VG<255>, by dividing a plurality of gamma tap voltages, e.g., the zeroth through fifth gamma tap voltages Vgmt0 through Vgmt5, respectively applied to a plurality of nodes ND1 through ND6.

Resistors between two adjacent nodes among the nodes ND1 through ND6 may have the same resistance value, or all resistors included in the sixth resistor string RS6 may have the same resistance value. Accordingly, differences between adjacent grayscale voltages between adjacent gamma tap voltages may be the same as each other. For example, a difference between two adjacent grayscale voltages among the zeroth through seventh grayscale voltages VG<0> through VG<7> may be the same as a difference between other two adjacent grayscale voltages among the zeroth through seventh grayscale voltages VG<0> through VG<7>. In addition, a difference between two adjacent grayscale voltages among the seventh through 75th grayscale voltages VG<7> through VG<75> may be the same as a difference between two other adjacent grayscale voltages among the seventh through 75th grayscale voltages VG<7> through VG<75>. As described above, grayscale voltages between adjacent gamma tap voltages may increase by a constant increment.

Figure 6A:
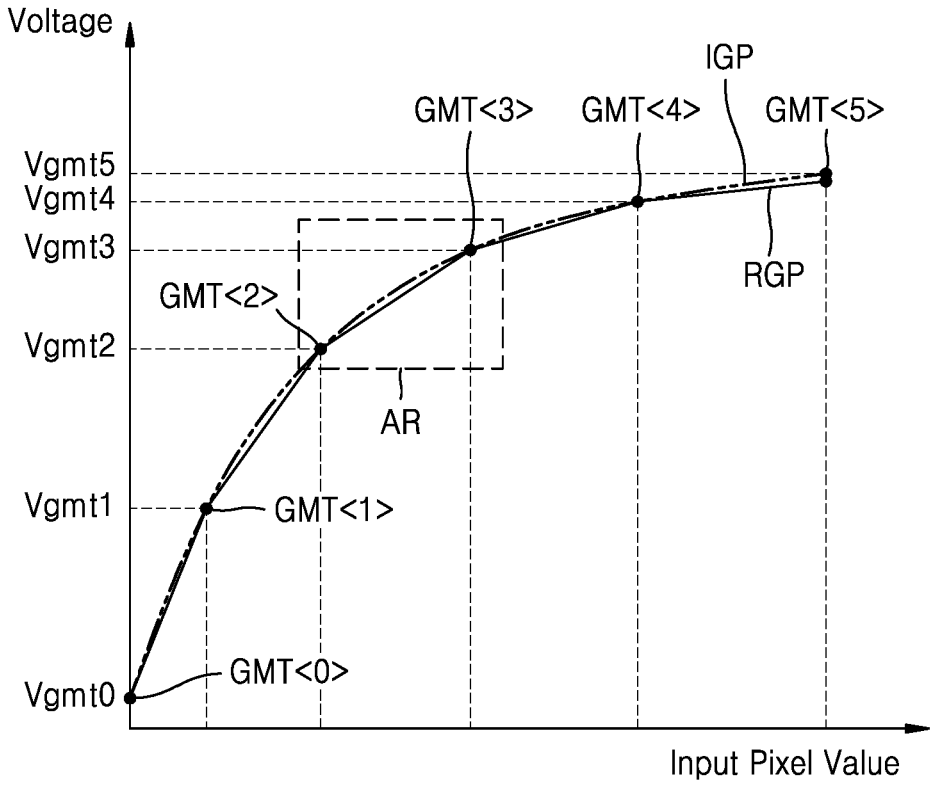
FIG. 6A is a graph of grayscale voltages output from a grayscale voltage generator according to an example embodiment.
Figure 6B:
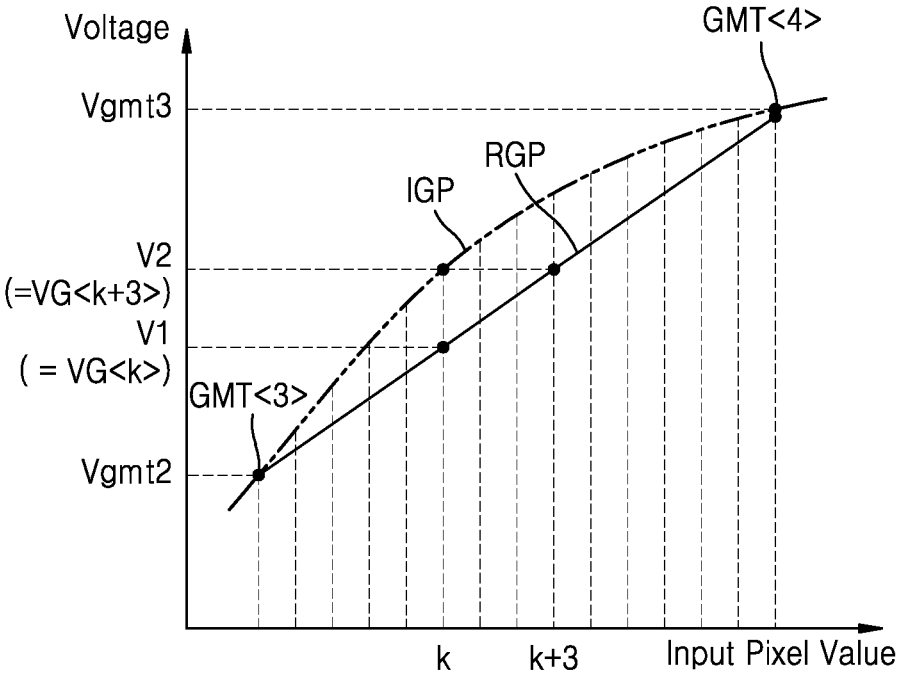
FIG. 6B is a graph for describing a gamma correction method of a gamma correction module, according to an example embodiment.

FIG. 6A is a graph of grayscale voltages output from a grayscale voltage generator, and FIG. 6B is a graph for describing a gamma correction method of a gamma correction module, according to an example embodiment. FIG. 6B shows a region AR in FIG. 6A in detail.

Referring to FIGS. 6A and 6B, the horizontal axis represents an input pixel value and the vertical axis represents a voltage, e.g., grayscale voltage. An input pixel value represents a grayscale. The solid line denotes a real grayscale voltage graph RGP corresponding to a plurality of grayscale voltages generated by a grayscale voltage generator (e.g., the grayscale voltage generator 115 of FIG. 5), and the dashed line denotes an ideal grayscale voltage graph IGP corresponding to a plurality of ideal grayscale voltages.

As described above with reference to FIG. 5, the zeroth through fifth gamma tap voltages Vgmt0 through Vgmt5 respectively corresponding to a plurality of gamma taps GMT<0> through GMT<5> may be respectively adjusted according to the first through sixth select signals CS1 through CS6. Accordingly, grayscale voltages respectively corresponding to the zeroth through fifth gamma tap voltages Vgmt0 through Vgmt5 may be the same between the real grayscale voltage graph RGP and the ideal grayscale voltage graph IGP. Grayscale voltages between two adjacent gamma tap voltages among the zeroth through fifth gamma tap voltages Vgmt0 through Vgmt5 may linearly increase in the real grayscale voltage graph RGP but non-linearly increase in the ideal grayscale voltage graph IGP. As a result, a gamma error may occur.

Referring to FIG. 6B, a plurality of grayscale voltages between the second gamma tap voltage Vgmt2 and the third gamma tap voltage Vgmt3 may linearly increase in the real grayscale voltage graph RGP but non-linearly increase in the ideal grayscale voltage graph IGP.

For example, an input pixel value may indicate a k-th grayscale, and a k-th grayscale voltage VG<k> generated by the grayscale voltage generator 115 may be a first voltage V1. However, an ideal grayscale voltage corresponding to the k-th grayscale may be a second voltage V2, and the second voltage V2 may be equal to a (k+3)-th grayscale voltage VG<k+3> generated by the grayscale voltage generator 115 in correspondence to a (k+3)-th grayscale.

Referring to FIGS. 4 and 6B, the gamma correction module 10 may generate a compensated pixel value based on an input pixel value of the input pixel data IPD and generate the compensated pixel data CPD including the compensated pixel value. For example, the gamma correction module 10 may convert an input pixel value indicating the k-th grayscale into a compensated pixel value indicating the (k+3)-th grayscale corresponding to an ideal grayscale voltage, e.g., the second voltage V2, corresponding to the k-th grayscale. The gamma correction module 10 may generate the compensated pixel value by adding a compensation value to the input pixel value. For example, the gamma correction module 10 may generate a compensated pixel value of (k+3) by adding a compensation value of "3" to an input pixel value of "k".

The gamma correction module 10 may include a compensation value calculator 11. The compensation value calculator 11 may generate a compensation value corresponding to an input pixel value by using a compensation model having a quadratic function form. The compensation value calculator 11 may include at least one operator or processor, which performs a quadratic function calculation.

Referring to FIG. 6B, the closer a grayscale corresponding to a real grayscale voltage is to a gamma tap corresponding to a gamma tap voltage, e.g., the second gamma tap voltage Vgmt2 or the third gamma tap voltage Vgmt3, the less may be the difference between the real grayscale voltage and an ideal grayscale voltage. The further away a grayscale corresponding to a real grayscale voltage is from a gamma tap voltage, the greater may be the difference between the real grayscale voltage and an ideal grayscale voltage. Reflecting such characteristics of the difference between a real grayscale voltage and an ideal grayscale voltage, a compensation model may calculate a compensated pixel value, which increases when a grayscale indicated by an input pixel value is further away from a gamma tap and decreases when a grayscale indicated by an input pixel value is closer to a gamma tap. The compensation model will be described in detail with reference to FIGS. 7 through 12 below.

The gamma correction module 10 may generate a compensated pixel value by adding a compensation value to an input pixel value. In an embodiment, the gamma correction module 10 may generate a compensated pixel value by multiplying a compensation value, which is calculated by the compensation value calculator 11, by at least one weight based on luminance setting and/or color setting of the display panel 120 and by adding a multiplication result to an input pixel value.

The dithering module 20 may perform dithering on the compensated pixel data CPD received from the gamma correction module 10 and generate output pixel data OPD as a dithering result. Dithering methods known to one of ordinary skill in the art may be performed by the dithering module 20.

In an embodiment, the dithering module 20 may perform spatial dithering. The dithering module 20 may generate the output pixel data OPD by performing dithering based on at least one piece of compensated pixel data corresponding to a pixel PX adjacent to a pixel PX corresponding to the output pixel data OPD. For example, the dithering module 20 may generate the output pixel data OPD corresponding to a first pixel based on first compensated pixel data corresponding to the first pixel and second compensated pixel data corresponding to a second pixel adjacent to the first pixel. The dithering module 20 may generate the output pixel data OPD by performing a certain operation on the first compensated pixel data and the second compensated pixel data.

In an embodiment, the dithering module 20 may perform temporal dithering. The dithering module 20 may vary the output pixel data OPD during a plurality of frame periods such that a pixel PX outputs an optical signal having on average luminance corresponding to the compensated pixel data CPD during the frame periods. For example, when the compensated pixel data CPD indicates a 2.5th grayscale, the dithering module 20 may generate the output pixel data OPD indicating a 2nd grayscale during a first frame period, in which a first image is displayed on the display panel 120, and generate the output pixel data OPD indicating a 3rd grayscale during a second frame period, in which a second image or the first image is displayed on the display panel 120. Accordingly, an optical signal having luminance corresponding to the 2.5th grayscale on average may be output from the pixel PX during the first and second frame periods.

In an embodiment, the dithering module 20 may perform dithering on the compensated pixel data CPD including M-bit data (where M is a positive integer of 8 or greater, for example) to generate N-bit data (where N is a positive integer less than or equal to M).

In an embodiment, the display driving circuit 110 may not include the dithering module 20. In this case, the compensated pixel data CPD may be provided to the data driver 114 as the output pixel data OPD.

The DAC 41 may receive a plurality of grayscale voltages, e.g., the zeroth through 255th grayscale voltages VG<0> through VG<255>, from the grayscale voltage generator 115 and may select one of the zeroth through 255th grayscale voltages VG<255:0> based on the output pixel data OPD. The DAC 41 may output a selected grayscale voltage VSG to the output buffer 42. The output pixel data OPD may select a grayscale voltage closest to an ideal grayscale voltage of a grayscale indicated by the input pixel data IPD among the zeroth through 255th grayscale voltages VG<255:0>.

The output buffer 42 may perform buffering (e.g., voltage or current buffering) on the selected grayscale voltage VSG and may output a buffered voltage, as the data voltage VD, to the display panel 120, and more particularly, to the data line DL (in FIG. 2) of the display panel 120.

As described above, according to an example embodiment, the gamma correction module 10 of the display driving circuit 110 may calculate a compensated pixel value with respect to a pixel value, i.e., an input pixel value, of the input pixel data IPD using a compensation model having a quadratic function form and provide the output pixel data OPD based on the compensated pixel value to the data driver 114. Accordingly, gamma errors caused by a characteristic of the grayscale voltage generator 115 may be reduced.

Figure 7:
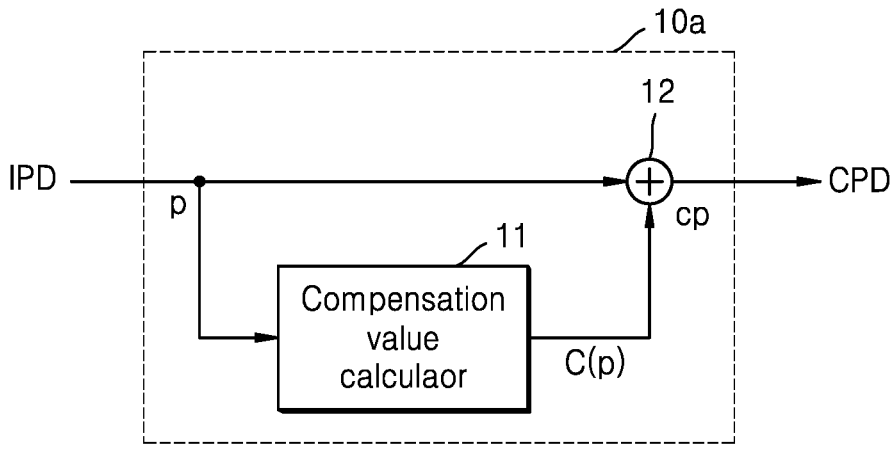
FIG. 7 is a block diagram of an example of a gamma correction module according to an example embodiment.

FIG. 7 is a block diagram of an example of a gamma correction module according to an example embodiment. A gamma correction module 10*a* shown in FIG. 7 may be applied to the display driving circuit 110 of FIG. 4.

Referring to FIG. 7, the gamma correction module 10*a* may include the compensation value calculator 11 and an adder 12 and may generate the compensated pixel data CPD based on a compensated pixel value "cp" by performing gamma correction based on a pixel value of the input pixel data IPD, i.e., an input pixel value p. The input pixel data IPD and the compensated pixel data CPD may be multi-bit data and may have the same number of bits as each other.

Figure 8:
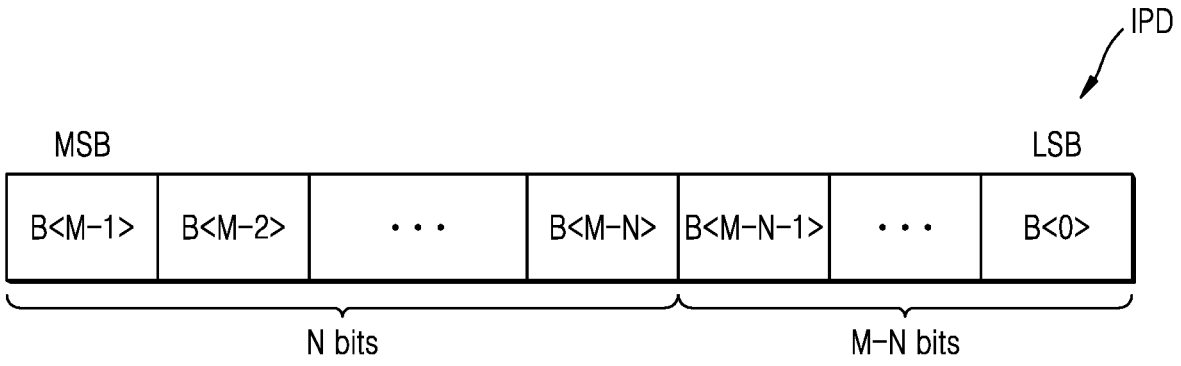
FIG. 8 illustrates an example of input pixel data.

FIG. 8 illustrates an example of the input pixel data IPD.

Referring to FIG. 8, the input pixel data IPD may include M-bit data (where M is a positive integer of 8 or greater, for example), which includes high-order N-bit data B<M−1> through B<M−N> (where N is a positive integer less than or equal to M) including a most significant bit (MSB) of the M-bit data, and includes low-order (M−N)-bit data B<M−N−1> through B<0> including a least significant bit (LSB) of the M-bit data. In an embodiment, the high-order N-bit data B<M−1> through B<M−N> may represent an integer value of the input pixel data IPD, and the low-order (M−N)-bit data B<M−N−1> through B<0> may represent a decimal value of the input pixel data IPD. For example, the input pixel data IPD may include high-order 8-bit data representing an integer value and low-order 4-bit data representing a decimal value. However, embodiments are not limited thereto. In another example, M may be equal to N, and the input pixel data IPD may have an integer value.

Referring back to FIG. 7, the compensation value calculator 11 may generate a compensation value C(p) corresponding to the input pixel value p based on a compensation model having a quadratic function form.

The compensation value calculator 11 may generate the compensation value C(p) based on Equation 1.

$$C(p)=W_{cmpn}(p)\times C_{model}(p) \quad \text{<Equation 1>}$$

Here, $C_{model}(p)$ represents a compensation model having a quadratic function form with respect to the input pixel value p, and $w_{cmpn}(p)$ is a first weight representing an amplitude and a sign of the compensation model $c_{model}(p)$ and may be determined based on the input pixel value p. The compensation model $c_{model}(p)$ may be expressed as Equation 2.

$$C_{model}(p)=\left(\frac{p-P_i}{P_{i+1}-P_i}\right)\times\left\{1-\left(\frac{p-P_i}{P_{i+1}-P_i}\right)\right\}, \quad (P_i \le p < P_{i+1}) \quad \text{< Equation 2 >}$$

Here, i is an index corresponding to the input pixel value p, $P_i$ is a gamma tap having a less value between two gamma taps closest to the input pixel value p, and $P_{i+1}$ is a gamma tap having a greater value between the two gamma taps. The two gamma taps may respectively represent corresponding grayscales.

$$\left(\frac{p-P_i}{P_{i+1}-P_i}\right)$$

may be determined according to the input pixel value p. When $$\left(\frac{p-P_i}{P_{i+1}-P_i}\right)$$

is replaced with X and $C_{model}(p)$ is replaced with Y, Equation 2 may be rewritten as Equation 3.

$$Y=X\times(1-X) \quad \text{<Equation 3>}$$

Figure 9:
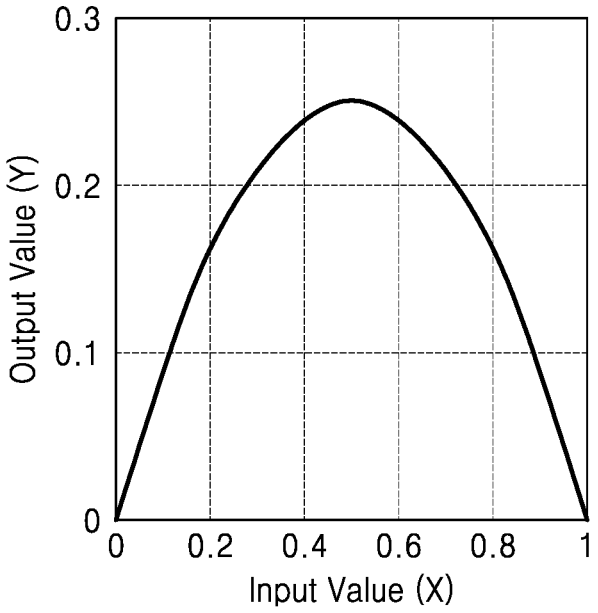
FIG. 9 is a graph showing a compensation model according to an example embodiment.

FIG. 9 is a graph showing a compensation model according to an example embodiment.

FIG. 9 illustrates the compensation model represented by Equation 3. The horizontal axis represents X in Equation 3, and the vertical axis represents Y, i.e., the compensation model $c_{model}(p)$. As show in FIG. 9, the compensation model $C_{model}(p)$ may be a quadratic function with respect to the input pixel value p.

FIG. 10 is an operation table applied to a compensation value calculator, according to an example embodiment. An operation table TB1 of FIG. 10 may be used by the compensation value calculator 11.

Referring to FIG. 10, input pixel values p may be classified into a plurality of pixel value ranges, e.g., zeroth through tenth ranges R0 through R10, respectively corresponding to indices i. The zeroth through tenth ranges R0 through R10 may be respectively classified as eleven pixel value groups based on a plurality of gamma taps, e.g., zeroth through eleventh gamma taps. For example, a zeroth gamma tap $P_0$ may indicate a zeroth grayscale, a first gamma tap $P_1$ may indicate a 1st grayscale, a fourth gamma tap $P_4$ may indicate a 35th grayscale, and a tenth gamma tap $P_{10}$ may indicate a 203rd grayscale.

The first weight $w_{cmpn}(p)$ may be set for each of eleven pixel value ranges. For example, the first weight $w_{cmpn}(p)$ may be set to 0.0 for the zeroth range R0 in which an input pixel value p indicates a grayscale equal to or greater than the zeroth gamma tap $P_0$ and less than the first gamma tap $P_1$ (e.g., equal to or greater than the zeroth grayscale and less than the 1st grayscale), the first range R1 in which the input pixel value p indicates a grayscale equal to or greater than the first gamma tap $P_1$ and less than a second gamma tap $P_2$ (e.g., equal to or greater than the 1st grayscale and less than a 7th grayscale), and the tenth range R10 in which the input pixel value p indicates a grayscale equal to or greater than the tenth gamma tap $P_{10}$ and less than an eleventh gamma tap $P_{11}$ (e.g., equal to or greater than the 203rd grayscale and less than the 255th grayscale). The first weight $w_{cmpn}(p)$ may be set to 1.68 for a fifth range R5 in which the input pixel value p indicates a grayscale equal to or greater than the fourth gamma tap $P_4$ and less than a fifth gamma tap $P_5$ (e.g., equal to or greater than the 35th grayscale and less than the 51st grayscale), may be set to 5.94 for a sixth range R6 in which the input pixel value p indicates a grayscale equal to or greater than the fifth gamma tap $P_5$ and less than a sixth gamma tap $P_6$ (e.g., equal to or greater than the 51st grayscale and less than the 87th grayscale), and may be set to 8.06 for a seventh range R7 in which the input pixel value p indicates a grayscale equal to or greater than the sixth gamma tap $P_6$ and less than a seventh gamma tap $P_7$ (e.g., equal to or greater than the 87th grayscale and less than the 151st grayscale). The first weight $w_{cmpn}(p)$ may be set based on a compensation degree (e.g., the difference between a real grayscale voltage and an ideal grayscale voltage) for each of the pixel value ranges, e.g., the zeroth through tenth ranges R0 through R10. For example, a compensation degree for each of the zeroth through tenth ranges R0 through R10 may be empirically determined.

Figure 11:
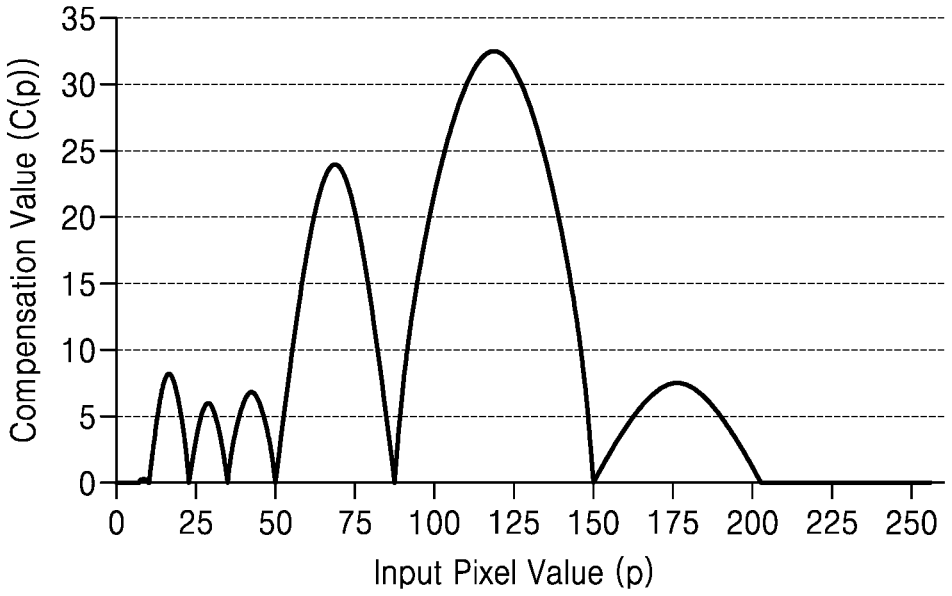
FIG. 11 is a graph showing compensated pixel values generated by a compensation value calculator, according to an example embodiment.

FIG. 11 is a graph showing compensated pixel values generated by a compensation value calculator, according to an example embodiment.

The horizontal axis represents the input pixel value p, and the vertical axis represents the compensation value C(p). The compensation value C(p) having a quadratic function form with respect to the input pixel value p between two adjacent gamma taps may be generated. When the input pixel value p corresponds to one of a plurality of gamma taps, the compensation value C(p) may be "0", and when the input pixel value p corresponds to a median value between the first gamma tap and the second gamma tap, the compensation value C(p) may have a maximum value. The sign and amplitude of the quadratic function may be determined by the first weight $w_{cmpn}(p)$ set for a pixel value range, to which the input pixel value p belongs, as described above with reference to FIG. 10.

Referring back to FIG. 7, the adder 12 may add the compensation value C(p) to the input pixel value "p". As a result, a compensated pixel value cp may be generated. The compensated pixel data CPD based on the compensated pixel value "cp" may be output.

According to the gamma correction module 10*a* of FIG. 7, the compensated pixel value "cp" corresponding to each of the pixels PX of the display panel 120 may be expressed as Equation 4.

$$CPD(x,y)=IPD(x,y)+C(IPD(x,y)) \quad \text{<Equation 4>}$$

Here, IPD(x, y) represents the input pixel value "p" of the input pixel data IPD corresponding to a particular pixel PX, e.g., a pixel PX at a row 'x' and a column 'y' (where x and y are positive integers) of the display panel 120; and CPD(x, y) represents the compensated pixel value "cp" of the compensated pixel data CPD corresponding to the pixel PX. The gamma correction module 10*a* may calculate a compensation value C(IPD(x, y)) based on the input pixel value IPD(x, y) of the pixel PX at the row 'x' and the column 'y' and may generate the compensated pixel value CPD(x, y) of the pixel PX at the row 'x' and the column 'y' by adding the compensation value C(IPD(x, y)) to the input pixel value IPD(x, y).

Figure 12A:
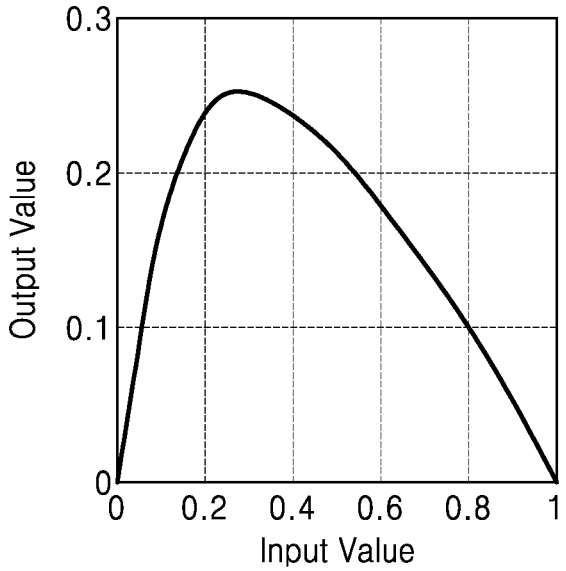
FIGS. 12A and 12B are graphs showing compensation models according to example embodiments.
Figure 12B:
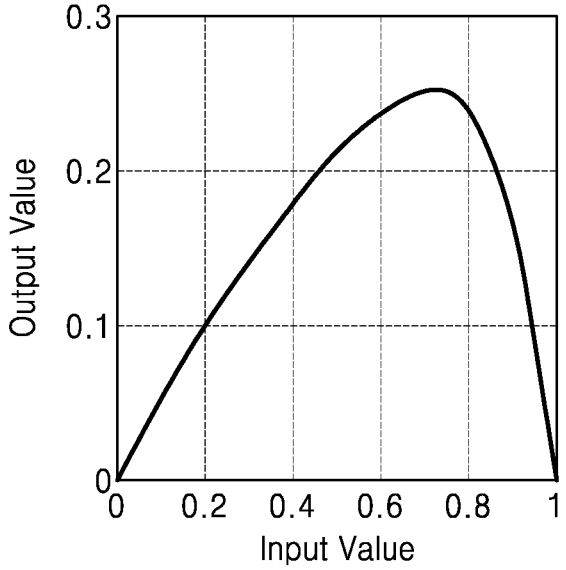

FIGS. 12A and 12B are graphs showing compensation models according to example embodiments.

According to an example embodiment, when the compensation value calculator 11 in FIG. 7 calculates the compensation value C(p), a compensation model $C_{model}(p)'$ expressed by Equation 5 may be used.

$$C_{model}(p)' = \left(\frac{p-P_i}{P_{i+1}-P_i}\right)^{\beta} \times \left\{1-\left(\frac{p-P_i}{P_{i+1}-P_i}\right)^{\beta}\right\} (P_i \le p < P_{i+1}) \quad \text{< Equation 5 >}$$

Here, β is a parameter adjusting the form of the compensation model $C_{model}(p)'$. When β is a real number less than 1, the compensation model $C_{model}(p)'$ may have a quadratic function form biased to the left, as shown in FIG. 12A. When β is a real number greater than 1, the compensation model $C_{model}(p)'$ may have a quadratic function form biased to the right, as shown in FIG. 12B. When β is 1, the compensation model $C_{model}(p)'$ may be the same as the compensation model $C_{model}(p)$ of Equation 2.

FIG. 13 is an operation table applied to a compensation value calculator, according to an example embodiment. An operation table TB2 of FIG. 13 may be used by a compensation value calculator (e.g., the compensation value calculator 11 in FIG. 7), according to an example embodiment.

Referring to FIG. 13, input pixel values p may be classified into a plurality of pixel value ranges, e.g., eleven pixel value ranges, respectively corresponding to indices i; and the parameter β and the first weight $W_{cmpn}(p)$ may be set for each of the pixel value ranges. The first weight $W_{cmpn}(p)$ and the parameter β may be set based on a compensation degree for each of a plurality of pixel value ranges, e.g., the zeroth through tenth ranges R0 through R10. The classification of pixel value ranges and the first weight $W_{cmpn}(p)$ have been described above with reference to FIG. 10, and redundant descriptions thereof will be omitted.

For example, β may be set to 0.75 for the fifth range R5 and to 1.25 for the seventh range R7. Accordingly, the compensation value (C(p)) may be obtained by using the compensation model having a quadratic function form biased to the left, as shown in FIG. 12A, in the fifth range R5 and by using the compensation model having a quadratic function form biased to the right, as shown in FIG. 12B, in the seventh range R7. For other pixel value ranges, e.g., the zeroth range R0, the first range R1, the sixth range R6, and the tenth range R10, β may be set to 1. Accordingly, the graph showing the compensation value (C(p)) may have a quadratic function form shown in FIG. 9 in the zeroth range R0, the first range R1, the sixth range R6, and the tenth range R10.

Figure 14:
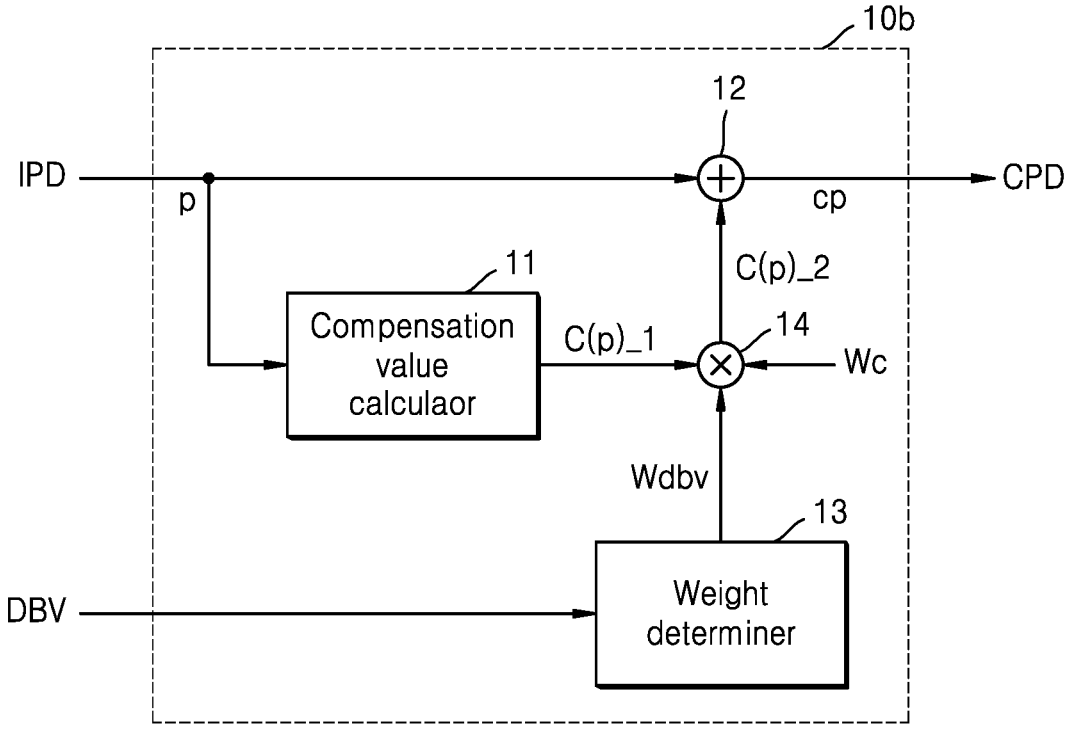
FIG. 14 is a block diagram of an example of a gamma correction module according to an example embodiment.

FIG. 14 is a block diagram of an example of a gamma correction module according to an example embodiment. A gamma correction module 10*b* may be applied to the display driving circuit 110 of FIG. 4.

Referring to FIG. 14, the gamma correction module 10*b* may include the compensation value calculator 11, the adder 12, a weight determiner 13, and a multiplier 14.

The compensation value calculator 11 may generate a compensation value, e.g., a first compensation value C(p)_1, corresponding to the input pixel value "p" based on a compensation model having a quadratic function form, as described above.

The weight determiner 13 may determine a second weight Wdbv based on a luminance setting DBV for the display panel 120. For example, the weight determiner 13 may store the second weight Wdbv for gamma correction with respect to each of a plurality of luminance ranges, which may be set for the display panel 120, and may output the second weight Wdbv corresponding to the luminance setting DBV.

The multiplier 14 may generate a second compensation value C(p)_2 by multiplying the first compensation value C(p)_1 by the second weight Wdbv.

In an embodiment, a third weight Wc that is set for each color may be determined. For example, the third weight Wc may be differently set for each of red, green, and blue colors. The multiplier 14 may multiply the first compensation value C(p)_1 by the second weight Wdbv and the third weight Wc or multiply the first compensation value C(p)_1 by the third weight Wc. In other words, the first compensation value C(p)_1 may be multiplied by at least one selected from the second weight Wdbv and the third weight Wc, and the second compensation value C(p)_2 may be generated as the multiplication result.

The adder 12 may add the second compensation value C(p)_2 output from the multiplier 14 to the input pixel value "p". As a result, the compensated pixel value cp may be generated. The compensated pixel data including the compensated pixel value cp may be output.

According to the gamma correction module 10*b* of FIG. 14, the compensated pixel value cp corresponding to each of the pixels PX of the display panel 120 may be expressed as Equation 6.

$$CPD(x,y)=IPD(x,y)+Wdbv\times Wc\times C(IPD(x,y))_1 \quad \text{<Equation 6>}$$

The gamma correction module 10*b* may calculate a first compensation value C(IPD(x, y))_1 based on the input pixel value IPD(x, y) of the pixel PX at the row 'x' and the column 'y' and may generate a second compensation value by multiplying the first compensation value C(IPD(x, y))_1 by at least one selected from the second weight Wdbv and the third weight Wc. any one of the second weight Wdbv and the third weight Wc that is not selected to apply may be set to "1". The gamma correction module 10*b* may generate the compensated pixel value CPD(x, y) of the pixel PX at the row 'x' and the column 'y' by adding the second compensation value, i.e., Wdbv×Wc×C(IPD(x, y))_1, to the input pixel value IPD(x, y).

Figure 15:
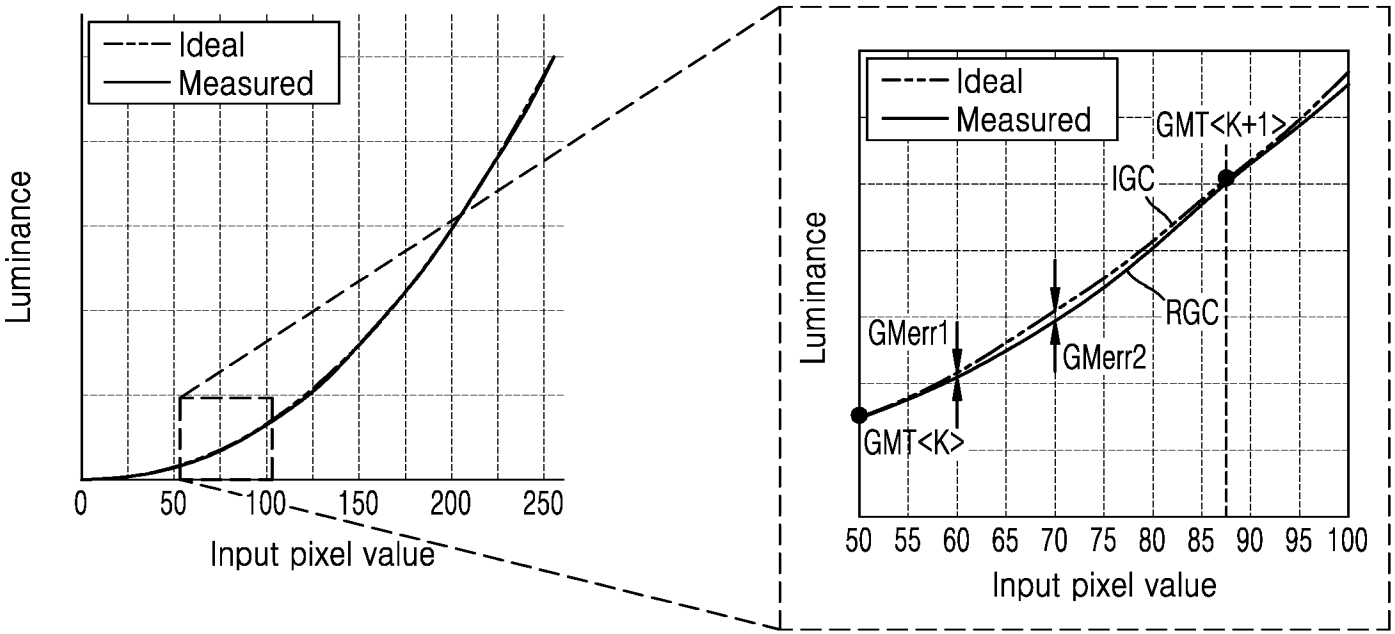
FIG. 15 is a graph for describing a gamma error.

FIG. 15 is a graph for describing a gamma error. FIG. 15 shows an ideal gamma curve IGC and a measured gamma curve RGC.

Luminance at each grayscale may be represented by the ideal gamma curve IGC based on ideal grayscale voltages. However, as described above with reference to FIGS. 6A and 6B, a grayscale voltage, which corresponds to a grayscale between two adjacent gamma taps among a plurality of grayscale voltages generated by the grayscale voltage generator 115, may be different from an ideal grayscale voltage corresponding to the grayscale, and the difference between the grayscale voltage generated by the grayscale voltage generator 115 and the ideal grayscale voltage may increase when the grayscale is further away from the adjacent gamma taps.

Accordingly, as shown in FIG. 15, a first gamma error GMerr1 and a second GMerr2 may occur between adjacent gamma taps, e.g., a K-th gamma tap GMT<K> and a (K+1)-th gamma tap GMT<K+1> (where K is 0 or a positive integer). A gamma error, e.g., the second gamma error GMerr2, occurring at a grayscale relatively away from a gamma tap may be greater than a gamma error, e.g., the first gamma error GMerr1, occurring at a grayscale relatively close to a gamma tap.

To solve this problem, according to an example embodiment, the display driving circuit 110 in FIG. 1 generates a compensation value with respect to an input pixel value based on a compensation model having a quadratic function form using the gamma correction module 10 and selects one of a plurality of grayscale voltages, which are generated by the grayscale voltage generator 115, based on compensated pixel data including the compensation value such that a grayscale voltage close to an ideal grayscale voltage may be selected. Accordingly, the display driving circuit 110 may reduce gamma errors caused by a characteristic of a grayscale voltage generator.

Figure 16:
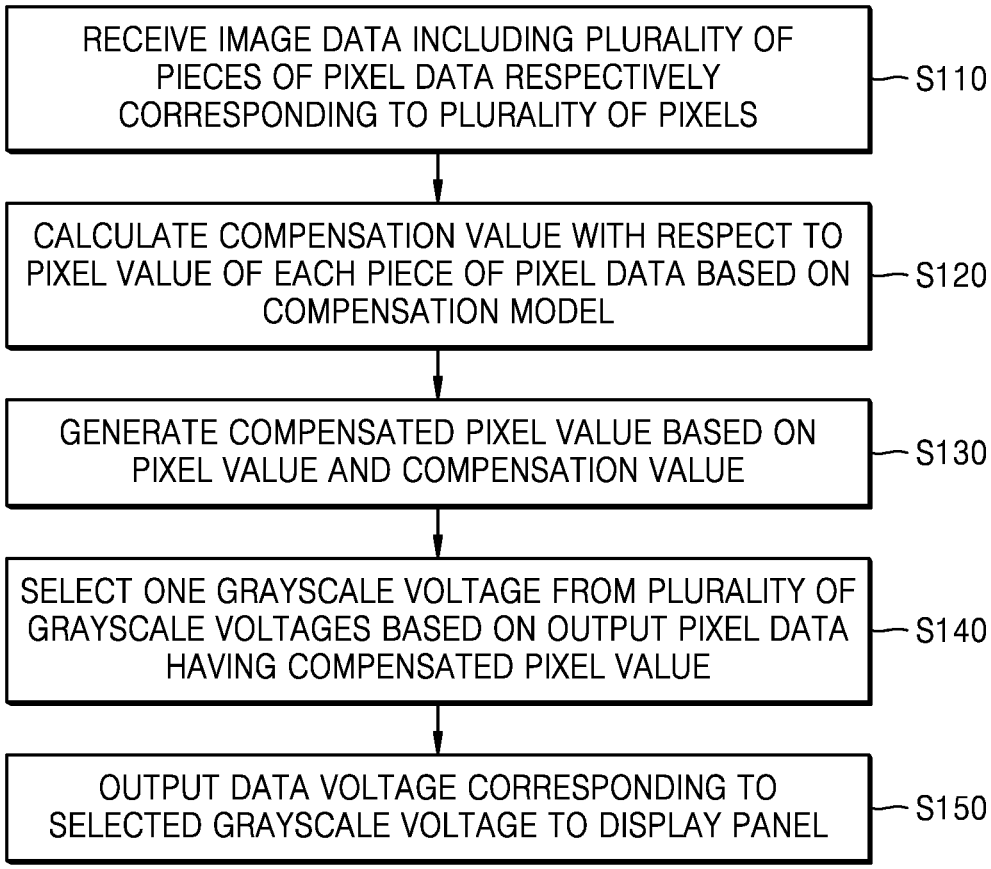
FIG. 16 is a flowchart of a method of operating a display driving circuit, according to an example embodiment.

FIG. 16 is a flowchart of an operating method of a display driving circuit, according to an example embodiment. The operating method of FIG. 16 may be performed by the display driving circuit 110 in FIGS. 1 through 3.

Referring to FIG. 16, the display driving circuit 110 may receive image data, which includes a plurality of pieces of pixel data respectively corresponding to a plurality of pixels, in operation S110. For example, the interface circuit 111 in FIG. 2 may receive the image data from the host processor 200, and the image data may be stored in the memory 113 or provided to the control logic 112.

The control logic 112, and more specifically, the gamma correction module 10 may calculate a compensation value with respect to a pixel value of each piece of pixel data based on a compensation model having a quadratic function form in operation S120. As described above with reference to FIG. 7, the compensation value calculator 11 may calculate a compensation value with respect to a pixel value based on a compensation model according to Equations 1 and 2.

The gamma correction module 10 may generate a compensated pixel value based on the pixel value and the compensation value in operation S130. In an embodiment, the gamma correction module 10 may generate the compensated pixel value by adding the compensation value to the pixel value. In an embodiment, the gamma correction module 10 may generate a second compensation value by multiplying the compensation value output from the compensation value calculator 11 by at least one selected from a weight, e.g., the second weight Wdbv in FIG. 14, based on a luminance setting of the display panel 120 and a weight, e.g., the third weight We in FIG. 14, based on a color setting and may generate the compensated pixel value by adding the second compensation value to the pixel value.

The data driver 114 may select one grayscale voltage from a plurality of grayscale voltages, which are provided from the grayscale voltage generator 115, based on output pixel data having the compensated pixel value in operation S140. In an embodiment, the control logic 112 may provide, as the output pixel data, compensated pixel data having the compensated pixel value to the data driver 114. In an embodiment, the control logic 112 may perform dithering on the compensated pixel data having the compensated pixel value and provide the output pixel data having a dithered compensated pixel value to the data driver 114. The data driver 114 may select a grayscale voltage, which corresponds to the output pixel data, from the grayscale voltages based on the output pixel data received from the control logic 112.

The data driver 114 may output a data voltage corresponding to the selected grayscale voltage to the display panel 120 in operation S150. For example, the output buffer 42 in FIG. 4 may buffer the selected grayscale voltage and output, as the data voltage, a buffered voltage to the data line DL of the display panel 120.

According to the example embodiment described above, gamma correction may also be applied to a display driving circuit using a digital gamma method as well as a display driving circuit using an analog gamma method. The analog gamma method refers to a method of converting a pixel value into a grayscale voltage based on a plurality of grayscale voltages reflecting a gamma curve. The digital gamma method refers to a method in which a pixel value is converted into a grayscale voltage value corresponding to the pixel value based on a plurality of grayscale voltage values (wherein a voltage value is digital data indicating a voltage level) respectively representing a plurality of grayscale voltages reflecting a gamma curve, and subsequently, digital data corresponding to the grayscale voltage value is converted into a grayscale voltage, i.e., the analog signal to be provided to the display panel, based on a plurality of grayscale voltages of which the voltage levels linearly increase.

Hereinafter, gamma correction according to an example embodiment that is applied to a display driving circuit using the digital gamma method will be described with reference to FIGS. 17 through 19.

Figure 17:
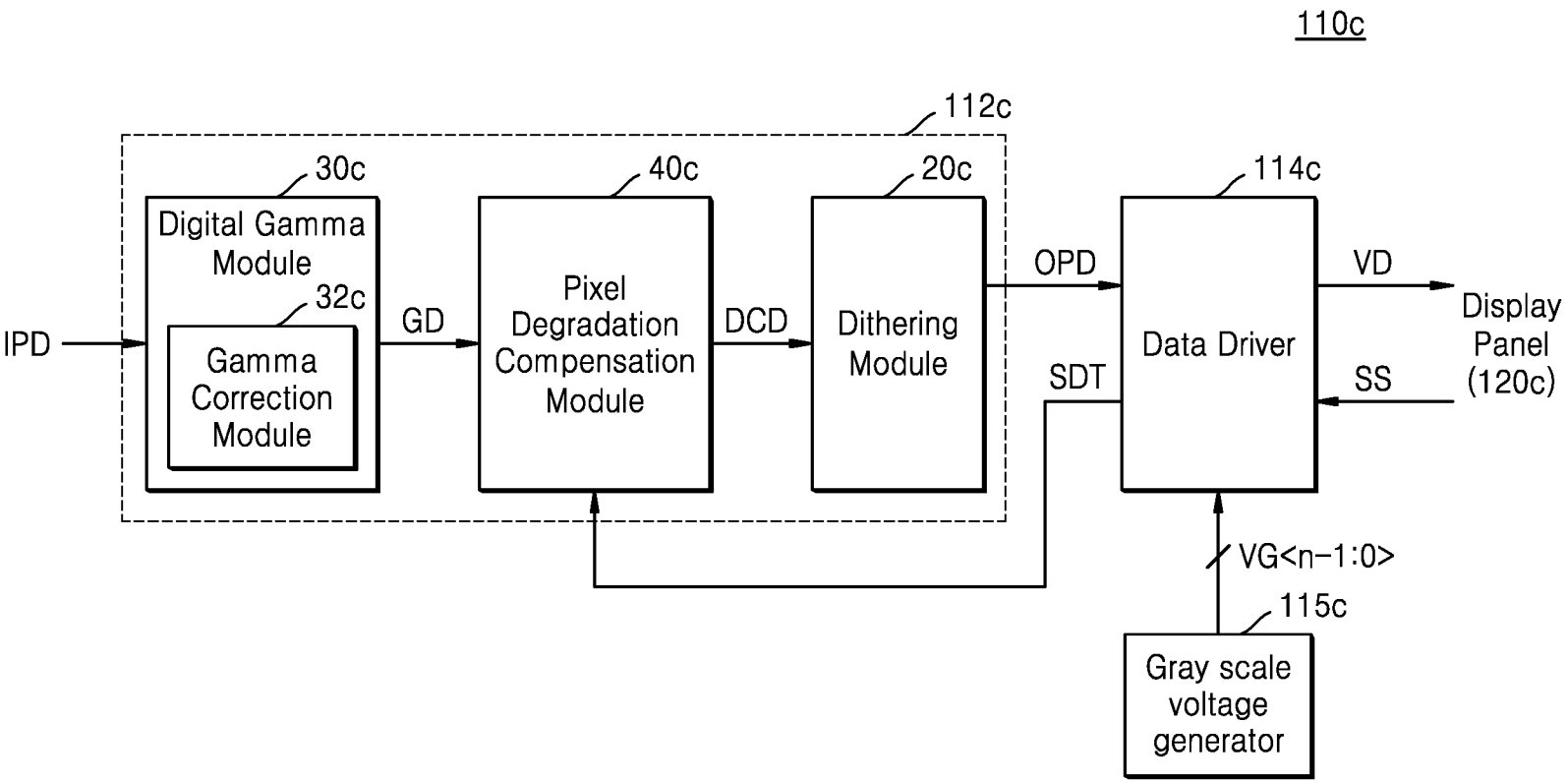
FIG. 17 is a schematic block diagram of a display driving circuit according to an example embodiment.
Figure 18:
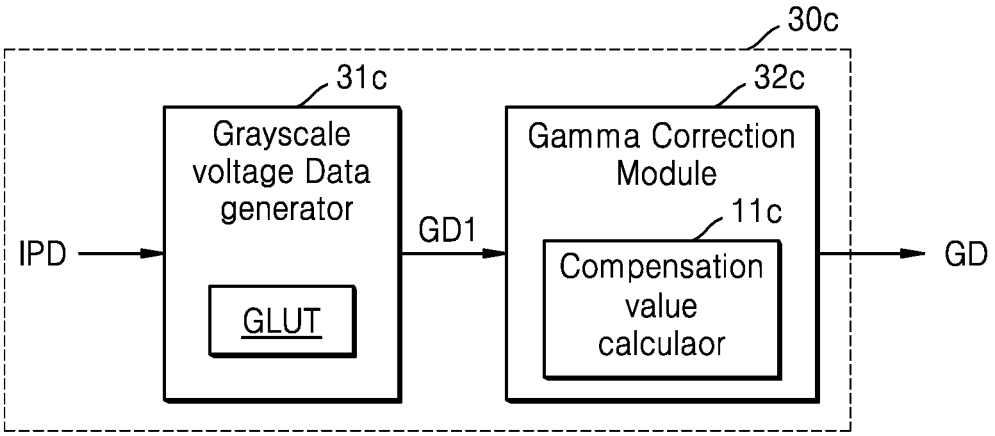
FIG. 18 is a block diagram of a digital gamma module according to an example embodiment.

FIG. 17 is a schematic block diagram of a display driving circuit according to an example embodiment, and FIG. 18 is a block diagram of a digital gamma module according to an example embodiment.

Referring to FIG. 17, a display driving circuit 110*c* may include a control logic 112*c*, a grayscale voltage generator 115*c*, and a data driver 114*c*. The control logic 112*c* may include a digital gamma module 30*c*, a pixel degradation compensation module 40*c*, and a dithering module 20*c*.

The grayscale voltage generator 115*c* may generate a plurality of grayscale voltages, e.g., the grayscale voltages VG<n−1:0>. A difference between two adjacent grayscale voltages among the grayscale voltages VG<n−1:0> may be the same as a difference between two other adjacent grayscale voltages among the grayscale voltages VG<n−1:0>. The grayscale voltages VG<n−1:0> may not reflect a gamma curve of a display panel 120*c*, and an increase in a voltage level among the grayscale voltages VG<n−1:0> may be linear. The gamma curve may be reflected in the digital gamma module 30*c*.

The digital gamma module 30*c* may convert a pixel value of the input pixel data IPD into a grayscale voltage data GD, taking into account the gamma curve of the display panel 120*c*. The grayscale voltage data GD is a digital value indicating a grayscale voltage corresponding to the pixel value.

Referring to FIG. 18, the digital gamma module 30*c* may include a grayscale voltage data generator 31*c* and a gamma correction module 32*c*.

The grayscale voltage data generator 31*c* may convert the input pixel data IPD into first grayscale voltage data GD1 indicating a grayscale voltage corresponding to a pixel value of the input pixel data IPD.

The grayscale voltage data generator 31*c* may include a gamma lookup table GLUT, which may include a plurality of gamma tap voltage values (referred to as reference gamma data values) respectively corresponding to a plurality of gamma tap voltages (referred to as reference gamma voltages). For example, the gamma lookup table GLUT may include a plurality of gamma taps (e.g., reference grayscales) and a plurality of gamma tap voltage values respectively corresponding to the gamma taps. The gamma tap voltage values may be set taking into account a gamma curve.

The grayscale voltage data generator 31*c* may generate a plurality of grayscale voltage values respectively corresponding to a plurality of grayscales based on a plurality of gamma tap voltage values. For example, the grayscale voltage data generator 31*c* may generate a plurality of grayscale voltage values by performing linear data distribution on two adjacent gamma tap voltage values. The grayscale voltage data generator 31*c* may output, as the first grayscale voltage data GD1, a grayscale voltage value corresponding to the pixel value of the input pixel data IPD among the generated grayscale voltage values.

When the grayscale voltage data generator 31*c* stores a plurality of grayscale voltage values respectively corresponding to a plurality of grayscales in the gamma lookup table GLUT and converting a pixel value of the input pixel data IPD into a grayscale voltage value by finding the grayscale voltage value corresponding to the pixel value in the gamma lookup table GLUT, a large capacity of storage is required to store the gamma lookup table GLUT. However, according to an embodiment, the grayscale voltage data generator 31*c* stores a plurality of gamma tap voltage values corresponding to some grayscales, i.e., a plurality of gamma taps, in the gamma lookup table GLUT and generates a plurality of grayscale voltage values using the gamma tap voltage values, wherein the some grayscales are reference grayscales among a plurality of grayscales, and accordingly, a large capacity of storage for storing the gamma lookup table GLUT is not required.

The grayscale voltage values generated by the grayscale voltage data generator 31*c* may linearly increase between two adjacent gamma tap voltage values. However, as described above with reference to FIG. 6A, an increase in a voltage level among ideal gray scale voltages may not be linear. Therefore, ideal grayscale voltages may be different from grayscale voltages respectively indicated by the grayscale voltage values generated by the grayscale voltage data generator 31*c*.

The gamma correction module 32*c* may perform gamma correction on the first grayscale voltage data GD1 received from the grayscale voltage data generator 31*c*, thereby compensating for the difference between an ideal grayscale voltage and a grayscale voltage indicated by a grayscale voltage value.

The gamma correction module 32*c* may generate a compensated grayscale voltage value by calculating a compensation value with respect to a grayscale voltage value of the first grayscale voltage data GD1 by using a compensation model having a quadratic function form and applying the compensation value to the grayscale voltage value. The gamma correction module 32*c* may output the compensated grayscale voltage value as grayscale voltage data GD.

The gamma correction module 32*c* may include a compensation value calculator 11*c*, which may calculate a compensation value based on Equations 1 and 2. In other words, the compensation value calculator 11*c* may calculate a compensation value with respect to a grayscale voltage value using a compensation model having a quadratic function form.

In Equations 1 and 2, the input pixel value "p" may be replaced with the grayscale voltage value of the first grayscale voltage data GD1, and a first weight may be set based on the range of the grayscale voltage value. For example, the range of the grayscale voltage value may be classified as one of a plurality of voltage value ranges defined based on a plurality of gamma voltage tap voltages, and the first weight may be set for each of the voltage value ranges.

Similarly to the description given with reference to FIG. 14 above, the gamma correction module 32*c* may multiply a compensation value, e.g., a first compensation value, output from the compensation value calculator 11*c* by at least one selected from a second weight based on the luminance setting DBV for the display panel 120 and a third weight that is set for each color and add the compensation value multiplied by a weight, e.g., a second compensation value, to an input grayscale voltage value, thereby generating a compensated grayscale voltage value. As described above, the gamma correction module 32*c* may perform gamma compensation, according to the embodiments described above.

Referring back to FIG. 17, the pixel degradation compensation module 40*c* may generate degradation compensated data DCD by performing a compensating process (hereinafter referred to as degradation compensation) on the grayscale voltage data GD to compensate for degradation of a pixel.

A pixel PX of the display panel 120*c* may be degraded over time or due to stress applied to the pixel PX and thus changed in an electrical characteristic, such as a threshold voltage of the drive transistor DT (in FIG. 3) or current mobility. The data driver 114*c* may receive a sensed signal SS, which indicates a change in an electrical characteristic of the pixel PX, e.g., a degradation degree, from the display panel 120*c*. The data driver 114*c* may generate sensed data SDT by performing analog-to-digital conversion on the sensed signal SS and may provide the sensed data SDT to the pixel degradation compensation module 40*c*.

The pixel degradation compensation module 40*c* may determine a degradation degree of the pixel PX based on the sensed data SDT and generate a degradation compensation value based on the degradation degree. The pixel degradation compensation module 40*c* may generate the degradation compensated data DCD by applying the degradation compensation value to the grayscale voltage data GD. For example, the pixel degradation compensation module 40*c* may add the degradation compensation value to the grayscale voltage data GD and output the addition result as the degradation compensated data DCD.

The dithering module 20*c* may perform dithering on the degradation compensated data DCD and output the dithering result as the output pixel data OPD. As described above with reference to FIG. 4, the dithering module 20*c* may perform temporal or spatial dithering.

The data driver 114*c* may select a grayscale voltage corresponding to the output pixel data OPD from the grayscale voltages VG<n−1:0> provided from the grayscale voltage generator 115*c*, buffer the selected grayscale voltage, and output a buffered voltage as the data voltage VD to the display panel 120*c*.

As described above, an increase in a voltage level among the grayscale voltages VG<n−1:0> may be linear. However, because the output pixel data OPD includes a grayscale voltage value corresponding to a grayscale of the input pixel data IPD, a grayscale voltage selected in correspondence to the output pixel data OPD may reflect the gamma curve of the display panel 120*c*.

As described above, according to an embodiment, the display driving circuit 110*c* may perform gamma correction using a compensation model having a quadratic function form when generating a data voltage reflecting a gamma curve using a digital gamma method. Accordingly, gamma errors may be reduced.

Figure 19:
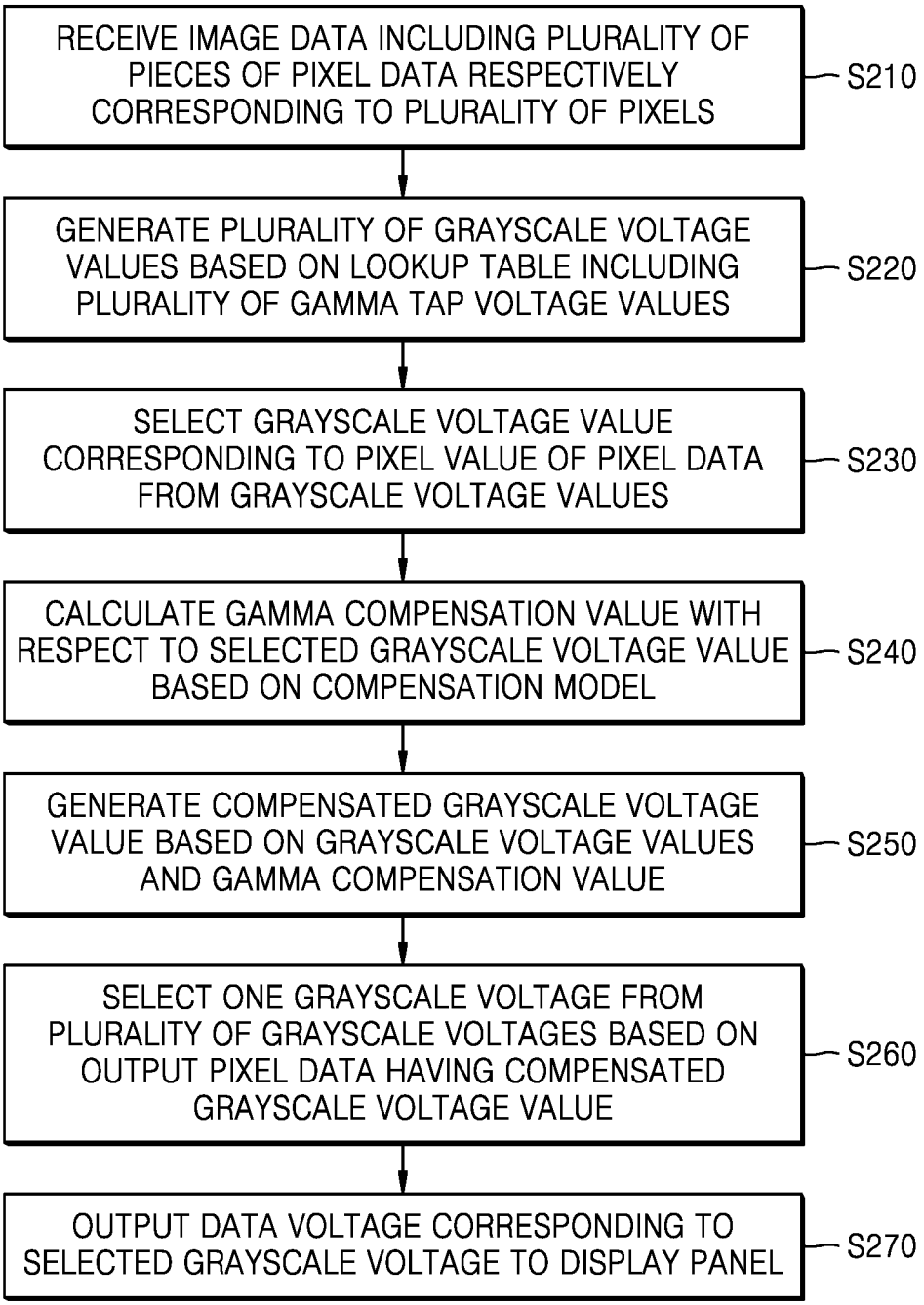
FIG. 19 is a flowchart of a method of operating a display driving circuit, according to an example embodiment.

FIG. 19 is a flowchart of an operating method of a display driving circuit, according to an example embodiment. The operating method of FIG. 19 may be performed by one or more of the display driving circuits 110 and 110*c* in FIGS. 1, 2, and 17.

Referring to FIGS. 17 and 19, the display driving circuit 110*c* may receive image data, which includes a plurality of pieces of pixel data respectively corresponding to a plurality of pixels, in operation S210. For example, the interface circuit 111 in FIG. 2 may receive the image data from the host processor 200, and the image data may be stored in the memory 113 or provided to the control logic 112*c*.

The control logic 112*c*, and more specifically, the digital gamma module 30*c* may generate a plurality of grayscale voltage values based on a gamma lookup table including a plurality of gamma tap voltage values in operation S220. The digital gamma module 30*c* may linearly distribute two adjacent gamma tap voltage values among a plurality of gamma tap voltage values, and accordingly, a plurality of grayscale voltage values linearly increasing among the gamma tap voltage values may be generated. The digital gamma module 30*c* does not need to store a plurality of grayscale voltage values respectively corresponding to a plurality of grayscales in a gamma lookup table, and accordingly, the capacity of storage for storing the gamma lookup table may be reduced.

The digital gamma module 30*c* may select a grayscale voltage value corresponding to a pixel value of input pixel data from the grayscale voltage values in operation S230.

The gamma correction module 32*c* may calculate a gamma compensation value, i.e., a compensation value with respect to the selected grayscale voltage value, based on a compensation model having a quadratic function form in operation S240. The gamma correction module 32*c* may calculate a compensation value with respect to a pixel value based on a compensation model according to Equations 1 and 2.

The gamma correction module 32*c* may generate a compensated grayscale voltage value based on the grayscale voltage value and the compensation value in operation S250. In an embodiment, the gamma correction module 32*c* may generate the compensated grayscale voltage value by adding the compensation value to the grayscale voltage value. In an embodiment, the gamma correction module 32*c* may generate a second compensation value by multiplying the compensation value, e.g., a first compensation value, which is calculated based on the compensation model having a quadratic function form, by at least one selected from a weight based on a luminance setting of the display panel 120*c* and a weight based on a color setting and may generate the compensated grayscale voltage value by adding the second compensation value to the grayscale voltage value.

The data driver 114*c* may select one grayscale voltage from a plurality of grayscale voltages, which are provided from the grayscale voltage generator 115*c*, based on output pixel data having the compensated grayscale voltage value in operation S260. In an embodiment, the control logic 112*c* may provide, as the output pixel data, grayscale data having the compensated grayscale voltage value to the data driver 114*c*. In an embodiment, the control logic 112*c* may perform degradation compensation and dithering on the grayscale data having the compensated grayscale voltage value, as described above with reference to FIG. 17, and may provide the output pixel data having a degradation compensated and dithered grayscale value to the data driver 114*c*. The data driver 114*c* may select a grayscale voltage, which corresponds to the output pixel data, from the grayscale voltages, based on the output pixel data received from the control logic 112*c*.

The data driver 114*c* may output a data voltage corresponding to the selected grayscale voltage to the display panel 120*c* in operation S270. For example, the data driver 114*c* may buffer the selected grayscale voltage and output, as the data voltage, a buffered voltage to the data line DL of the display panel 120*c*.

Figure 20:
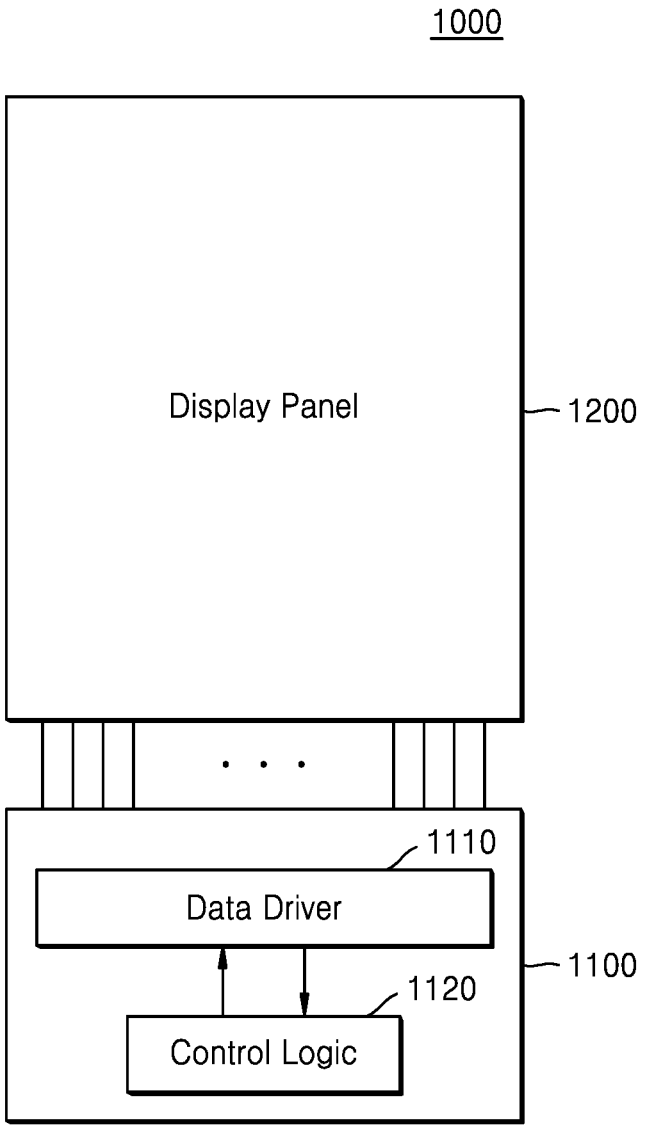
FIG. 20 is a diagram of an example of a display device according to an example embodiment.

FIG. 20 is a diagram of an example of a display device according to an example embodiment. A display device 1000 of FIG. 20 may include a display panel 1200, which is small in size, and may be applied to mobile devices such as a smartphone and a tablet PC.

Referring to FIG. 20, the display device 1000 may include a display driving circuit 1100 and the display panel 1200. The display driving circuit 1100 may include at least one IC and may be mounted on a circuit film such as a tap carrier package (TCP), a chip on film (COF), or a flexible printed circuit (FPC) and attached to the display panel 1200 by using tape automatic bonding (TAB) or may be mounted on a non-display region (e.g., a region in which an image is not displayed) of the display panel 1200 by using a chip on glass (COG) method.

The display driving circuit 1100 may include a data driver 1110 and a control logic 1120 and may further include a gate driver. In an embodiment, the gate driver may be mounted on the display panel 1200.

As described above with reference to FIGS. 1 through 18, the control logic 1120 may include the gamma correction module 10 (in FIG. 1), and the gamma correction module 10 may generate a compensated pixel value by calculating a compensation value with respect to an input pixel value by using a compensation model having a quadratic function form and applying the compensation value to the input pixel value. As described above, the gamma correction module 10 may perform gamma compensation by converting the input pixel value into the compensated pixel value based on the compensation model. The data driver 1110 may drive the display panel 1200 based on the compensated pixel value. Accordingly, the quality of an image displayed on the display panel 1200 may be increased.

Figure 21:
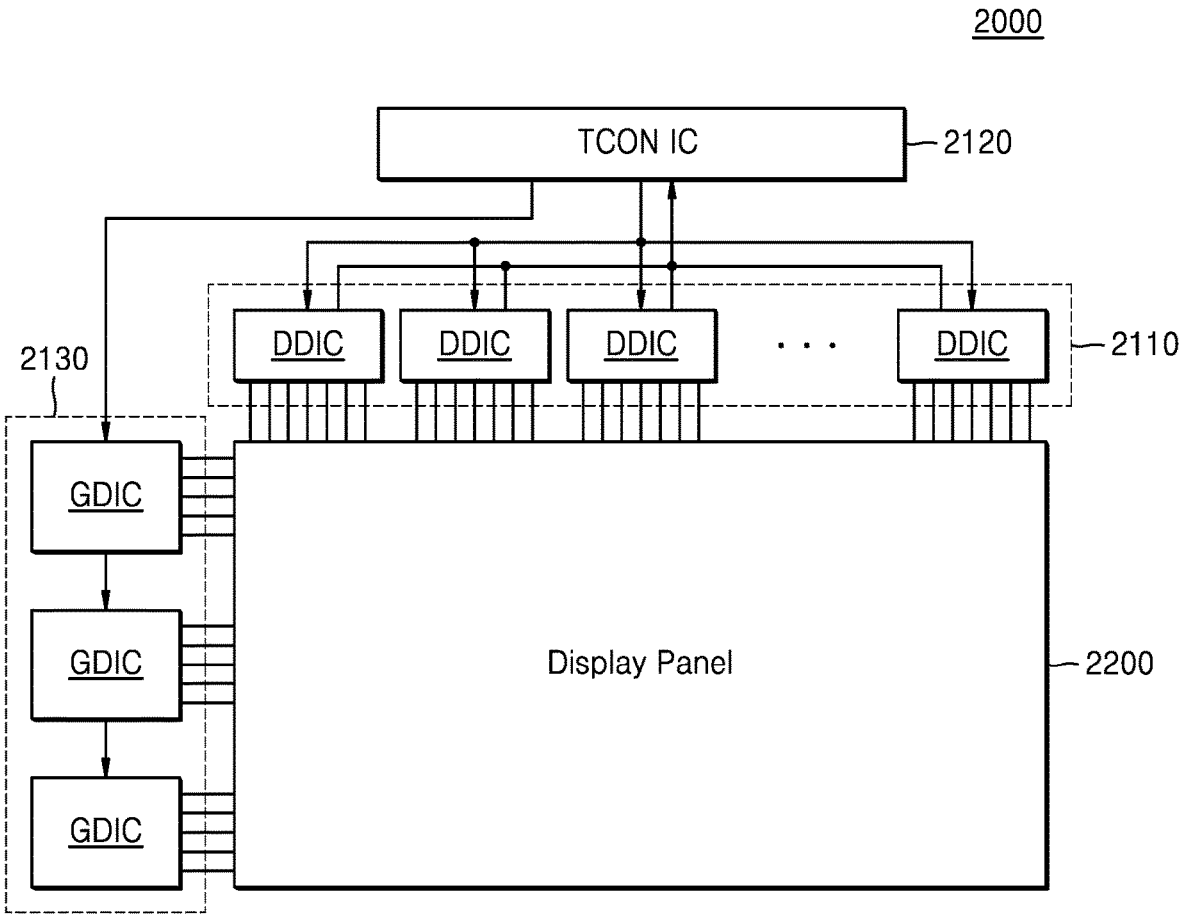
FIG. 21 is a diagram of an example of a display device according to an example embodiment.

FIG. 21 is a diagram of an example of a display device according to an example embodiment. A display device 2000 of FIG. 21 may include a display panel 2200, which is medium or large in size, and may be applied to, for example, a television and a monitor.

Referring to FIG. 21, the display device 2000 may include a data driver 2110, a timing controller 2120, a gate driver 2130, and the display panel 2200.

The timing controller 2120 may include at least one IC or module. The timing controller 2120 may communicate with a plurality of data driving ICs DDIC and a plurality of gate driving ICs GDIC through a preset interface.

The timing controller 2120 may generate control signals for controlling driving timings of the data driving ICs DDIC and the gate driving ICs GDIC and may provide the control signals to the data driving ICs DDIC and the gate driving ICs GDIC.

The data driver 2110 includes the data driving ICs DDIC, which may be mounted on a circuit film such as a TCP, a COF, or a FPC and attached to the display panel 2200 by using TAB or may be mounted on a non-display region of the display panel 2200 by using a COG method.

The gate driver 2130 includes the gate driving ICs GDIC, which may be mounted on a circuit film and attached to the display panel 2200 by using TAB or may be mounted on a non-display region of the display panel 2200 by using a COG method. Alternatively, the gate driver 2130 may be directly formed on a lower substrate of the display panel 2200 by using a gate-driver in panel (GIP) method. The gate driver 2130 may be formed in a non-display region outside a pixel array, in which sub-pixels PX are formed, in the display panel 2200 by using the same TFT process as the sub-pixels PX.

The timing controller 2120 may include the gamma correction module 10 (in FIG. 1) described above with reference to FIGS. 1 through 19. The gamma correction module 10 may generate a compensated pixel value by calculating a compensation value with respect to an input pixel value by using a compensation model having a quadratic function form and applying the compensation value to the input pixel value. The timing controller 2120 may provide compensated image data including the compensated pixel value to the data driver 2110. The data driving ICs DDIC may drive the display panel 2200 based on the compensated image data. Accordingly, the quality of an image displayed on the display panel 2200 may be increased.

At least one of the components, elements, modules or units described herein may be embodied as various numbers of hardware, software and/or firmware structures that execute respective functions described above, according to an example embodiment. For example, at least one of these components, elements or units may use a direct circuit structure, such as a memory, a processor, a logic circuit, a look-up table, etc. that may execute the respective functions through controls of one or more microprocessors or other control apparatuses. Also, at least one of these components, elements or units may be specifically embodied by a module, a program, or a part of code, which contains one or more executable instructions for performing specified logic functions, and executed by one or more microprocessors or other control apparatuses. Also, at least one of these components, elements or units may further include or implemented by a processor such as a central processing unit (CPU) that performs the respective functions, a microprocessor, or the like. Two or more of these components, elements or units may be combined into one single component, element or unit which performs all operations or functions of the combined two or more components, elements of units. Also, at least part of functions of at least one of these components, elements or units may be performed by another of these components, element or units. Further, although a bus is not illustrated in the block diagrams, communication between the components, elements or units may be performed through the bus. Functional aspects of the above example embodiments may be implemented in algorithms that execute on one or more processors. Furthermore, the components, elements or units represented by a block or processing operations may employ any number of related art techniques for electronics configuration, signal processing and/or control, data processing and the like.

While the inventive concept has been particularly shown and described with reference to example embodiments thereof, it will be understood that various changes in form and details may be made therein without departing from the spirit and scope of the following claims.

What is claimed is:

1. A method of operating a display driving circuit, the method comprising:

calculating a compensation value with respect to a pixel value of input pixel data based on a first gamma tap and a second gamma tap, the first and the second gamma taps being close to the pixel value;

generating a compensated pixel value based on the pixel value and the compensation value;

selecting, from a plurality of grayscale voltages, a grayscale voltage based on output pixel data including the compensated pixel value; and outputting a data voltage corresponding to the selected grayscale voltage to a display panel, wherein the calculating the compensation value comprises calculating the compensation value by using a compensation model, the compensation model including a quadratic function based on the pixel value, the first gamma tap, and the second gamma tap.

2. The method of claim 1, wherein the calculating the compensation value includes:

multiplying a result of the quadratic function by a weight.

3. The method of claim 2, wherein the weight is set according to a range of a pixel value including the pixel value, among a plurality of weights that are differently set for a plurality of ranges of the pixel value, respectively.

4. The method of claim 2, wherein the weight is set based on at least one selected from a luminance setting of the display panel and a color of a pixel corresponding to the input pixel data.

5. The method of claim 1, further comprising:

determining a plurality of gamma tap voltages based on select signals; and generating the plurality of grayscale voltages by linearly dividing the plurality of gamma tap voltages.

6. A display driving circuit comprising:

a grayscale voltage generator configured to generate a plurality of grayscale voltages by linearly dividing a plurality of gamma tap voltages;

a gamma correction circuit configured to calculate a compensation value with respect to an input pixel value by using a first gamma tap and a second gamma tap, the first and the second gamma taps being close to the input pixel value, and configured to apply the compensation value to the input pixel value to generate a compensated pixel value; and a data driver configured to receive the plurality of grayscale voltages from the grayscale voltage generator, and output a data voltage corresponding to a grayscale voltage to a display panel, the grayscale voltage being selected from the plurality of grayscale voltages based on the compensated pixel value, wherein the gamma correction circuit includes a compensation value calculator circuit configured to calculate the compensation value by performing a quadratic function of a compensation model based on the input pixel value, the first gamma tap, and the second gamma tap.

7. The display driving circuit of claim 6, wherein the compensation value calculator circuit is further configured to multiply a result of the quadratic function by a weight and output a result of multiplication as the compensation value, the weight being set for a range of a pixel value including the input pixel value.

8. The display driving circuit of claim 6, wherein the compensation value calculator circuit is further configured to calculate the compensation value as zero when the input pixel value corresponds to one of the first gamma tap and the second gamma tap.

9. The display driving circuit of claim 6, wherein the compensation value calculator circuit is further configured to calculate the compensation value having a maximum value when the input pixel value corresponds to a median value between the first gamma tap and the second gamma tap.

10. The display driving circuit of claim 6, wherein the gamma correction circuit is further configured to generate the compensated pixel value by adding the compensation value to the input pixel value.

11. The display driving circuit of claim 6, wherein the gamma correction circuit is further configured to determine a weight based on at least one selected from a luminance setting for the display panel and a color of a pixel corresponding to the input pixel value, and configured to generate the compensated pixel value by multiplying the compensation value by the weight and adding a result of multiplication to the input pixel value.

12. The display driving circuit of claim 6, wherein the gamma correction circuit is further configured to calculate the compensation value by using the compensation model, which is denoted by $c_{model}(p)$, and expressed by the following Equation:

$$c_{model}(p) = \left(\frac{p - P_i}{P_{i+1} - P_i}\right) * \left\{1 - \left(\frac{p - P_i}{P_{i+1} - P_i}\right)\right\}$$

where p is the input pixel value, $P_i$ is the first gamma tap having a smaller value between two gamma taps closest to the input pixel value, and $P_{i+1}$ is the second gamma tap having a greater value between the two gamma taps.

13. The display driving circuit of claim 6, wherein the gamma correction circuit is further configured to calculate the compensation value by using the compensation model, which is denoted by $c_{model}(p)'$ and expressed by the following Equation:

$$C_{model}(p)' = \left(\frac{p - P_i}{P_{i+1} - P_i}\right)^{\beta} \times \left\{1 - \left(\frac{p - P_i}{P_{i+1} - P_i}\right)^{\beta}\right\}$$

where p is the input pixel value, $P_i$ is the first gamma tap having a smaller value between two gamma taps closest to the input pixel value, $P_{i+1}$ is the second gamma tap having a greater value between the two gamma taps, and β is a parameter that is set for a range of a pixel value including the input pixel value.

14. The display driving circuit of claim 6, further comprising a dithering circuit, configured to receive the compensated pixel value from the gamma correction circuit, configured to dither the compensated pixel value, and to provide a dithered pixel value to the data driver as output pixel data, upon which the grayscale voltage is selected from the plurality of grayscale voltages.

15. The display driving circuit of claim 6, wherein the input pixel value and the compensated pixel value include M-bit data (M being a positive integer of 8 or greater), high-order N-bit data including a most significant bit in the M-bit data represents an integer (N being a positive integer less than or equal to M), and low-order (M-N)-bit data including a least significant bit in the M-bit data represents a decimal.

16. A display device comprising:

a display panel; and a display driving circuit configured to drive the display panel to display an image, wherein the display driving circuit includes:

a grayscale voltage generator configured to determine a plurality of gamma tap voltages according to a plurality of select signals and configured to generate a plurality of grayscale voltages based on the plurality of gamma tap voltages;

a gamma correction circuit configured to calculate a compensation value with respect to an input pixel value by performing a quadratic function of a compensation model based on the input pixel value, a first gamma tap, and a second gamma tap, the first and the second gamma taps being close to the input pixel value, and configured to apply the compensation value to the input pixel value to generate a compensated pixel value; and a data driver configured to output a data voltage corresponding to a grayscale voltage to the display panel, the grayscale voltage being selected from the plurality of grayscale voltages based on the compensated pixel value.

* * * * *